US009945143B2

(12) United States Patent
Pannekoek et al.

(10) Patent No.: US 9,945,143 B2
(45) Date of Patent: Apr. 17, 2018

(54) SWIVELLING JOINT

(71) Applicant: Swivelpole Patent Pty Ltd, Mandurah DC, Western Australia (AU)

(72) Inventors: Robert John Pannekoek, Mandurah DC (AU); Peter Pannekoek, Mandurah DC (AU)

(73) Assignee: Swivelpole Patent Pty Ltd, Mandurah DC, Western (AU)

( * ) Notice: Subject to any disclaimer, the term of this patent is extended or adjusted under 35 U.S.C. 154(b) by 157 days.

(21) Appl. No.: 15/102,563

(22) PCT Filed: Dec. 10, 2014

(86) PCT No.: PCT/AU2014/050412
§ 371 (c)(1),
(2) Date: Jun. 8, 2016

(87) PCT Pub. No.: WO2015/085366
PCT Pub. Date: Jun. 18, 2015

(65) Prior Publication Data

US 2016/0312488 A1 Oct. 27, 2016

(30) Foreign Application Priority Data

Dec. 10, 2013 (AU) ..... 2013904795

(51) Int. Cl.
*E04H 12/18* (2006.01)
*E04H 12/32* (2006.01)

(52) U.S. Cl.
CPC ..... *E04H 12/187* (2013.01); *E04H 12/32* (2013.01)

(58) Field of Classification Search
CPC ..... F21V 21/26; F21V 21/28; F21V 21/30; F21V 21/36; F16L 2/028; F16L 2/032; F16L 27/0841; F16L 27/0849; H02G 3/06; E04H 12/18; E04H 12/187
See application file for complete search history.

(56) References Cited

U.S. PATENT DOCUMENTS 3,366,788 A * 1/1968 Lantery ..... F21V 21/28 174/86
5,016,154 A * 5/1991 Leeyeh ..... F21S 6/007 362/414

(Continued)

FOREIGN PATENT DOCUMENTS

WO WO 01/25687 4/2001 ..... F21V 21/36
WO WO 2013/152396 10/2013 ..... F21V 21/36

OTHER PUBLICATIONS

International Search Report from corresponding International Patent Application No. PCT/AU2014/050412, dated Mar. 25, 2015.

*Primary Examiner* — Daniel J Wiley
(74) *Attorney, Agent, or Firm* — Kusner & Jaffe

(57) ABSTRACT

A swiveling joint for use in a pole such as a light pole is disclosed. The swiveling joint connects a first member mounted to a lower leg of a pole with a second member mounted to an upper leg of the pole. The second leg has a skirt which sits around an annular portion of the first member, with a bearing member located between the first and second members. The bearing member can be moved from outside the second member between a locked position where the joint is fixed, and a released position where the joint can rotate.

19 Claims, 24 Drawing Sheets

(56) References Cited

U.S. PATENT DOCUMENTS

| | | | | |
|---|---|---|---|---|
| 6,902,200 | B1 * | 6/2005 | Beadle | F16C 11/04 285/185 |
| 6,957,332 | B1 | 10/2005 | Pannekoek | 285/184 |
| 6,957,832 | B1 * | 10/2005 | Pannekoek | E04H 12/187 248/122.1 |
| 7,690,822 | B2 * | 4/2010 | Kauffman | F21V 21/26 362/275 |
| 2014/0360754 | A1 * | 12/2014 | Walton | E04H 12/187 174/86 |

* cited by examiner

SWIVELLING JOINT

FIELD OF THE INVENTION

The present invention relates to a swiveling joint for use in light poles and similar structures. The swiveling joint is expected to be used in light poles in excess of 2m in height, or light poles having a light located outside of easy reach. It is anticipated that the swiveling joint may be used in other poles such as flag poles, or in raised elongate structures such as mountings for securing cameras.

BACKGROUND TO THE INVENTION

The Swivelpole™ is described in the International Patent Application published as WO0125687 and U.S. Pat. No. 6,957,832, the contents of which are incorporate herein by reference. This product consists of a light pole which has a swivelling joint along its length. The swivelling joint allows for safer and easier changing and repair of lights than had previously been available.

The Swivelpole™ has proved highly successful, and has become an important safety feature in many industrial, mining, and oil-and-gas installations. Nonetheless, it is considered that improvements may be possible in both the manufacture and use of the product.

The Swivelpole™ requires precise welding of flat plates onto tubing. Such welding requires considerable expertise, in addition to costly equipment. Inexpert welding can lead to distortion of the flat plates, resulting in an underperforming joint. It is considered desirable to have a joint which could be formed without welding, for instance by casting and machining. The Swivelpole™ cannot be easily formed by such a method.

In addition, by the nature of its design, the Swivelpole™ includes an open joint into which water and dust can locate. This is problematic in some applications.

The present invention seeks to improve some features of the previous Swivelpole™ design, particularly to allow for easier manufacture, whilst retaining the key concept of the swiveling joint.

SUMMARY OF THE INVENTION

According to one aspect of the present invention there is provided a swiveling joint including a first member, a second member, and at least one bearing member;

the first member being associated with a first leg, the first leg having a longitudinal direction, the first member having an annular base which is oriented at an acute angle relative to the longitudinal direction of the first leg, the base having an outer periphery;

the second member being associated with a second leg, the second leg having a longitudinal direction, the second member including an outer wall arranged to locate around the annular base of the first member to define an exterior surface of the swiveling joint;

the first member having a bearing surface located internally of the exterior surface of the swiveling joint;

the bearing member being connected to the second member by an adjustable connection means;

the bearing member locating within the outer wall of the second member, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

According to a second aspect of the present invention there is provided a swiveling joint including a first member, a second member, and at least one bearing member;

the first member being associated with a first leg, the first leg having a longitudinal direction, the first member having an annular base which is oriented at an acute angle relative to the longitudinal direction of the first leg, the base having an outer periphery;

the second member being associated with a second leg, the second leg having a longitudinal direction, the second member including an outer wall arranged to locate around the annular base of the first member to define an exterior surface of the swiveling joint;

the second member having a bearing surface located internally of the exterior surface of the swiveling joint;

the bearing member being connected to the first member by an adjustable connection means;

the bearing member locating within the outer wall of the second member, with the bearing surface of the bearing member being opposed to the bearing surface of the second member;

the adjustable connection means permitting relative movement of the bearing member and the first member between:

a first configuration, wherein the bearing surface of the bearing member and the bearing surface of the second member are in frictional engagement restricting rotational movement of the first member relative to the second member, and a second configuration, wherein rotation of the second member relative to the first member is permitted.

According to a third aspect of the present invention there is provided a swiveling joint including a first member, a second member, and at least one bearing member;

the first member being associated with a first leg, the first leg having a longitudinal direction, the first member having a base, the base having an outer periphery, the outer periphery being located in a plane, the plane being perpendicular to an operating axis, the operating axis being angled with respect to the longitudinal axis of the first leg at an offset angle;

the second member being associated with a second leg, the second leg having a longitudinal direction, the second member including an outer wall arranged to locate around the annular base of the first member to define an exterior surface of the swiveling joint;

the first member having a bearing surface located internally of the exterior surface of the swiveling joint;

the bearing member being connected to the second member by an adjustable connection means;

the bearing member locating within the outer wall of the second member, with the bearing surface of the bearing member being opposed to the bearing surface of the first member;

the adjustable connection means permitting relative movement of the bearing member and the first member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

Advantageously, the bearing connection, between the bearing surface of the bearing member and the bearing surface of the first or second member, is located internally of the joint and is protected from ingress of water or dust.

Preferably, the outer wall or skirt of the second member and the periphery of the annular base of the first member combine to define a circular track about which the second member can rotate relative to the first member when in the second configuration.

It is preferred that the bearing surface of the first or second member be annular. In the most preferred embodiments, the bearing surface of the first or second member is formed by an annular groove.

The annular groove may be formed from three surfaces: a cylindrical centre surface and two frusto conical outer surfaces.

The adjustable connection means may include a threaded bolt, such that threaded movement of the bolt causes movement between first and second configurations.

In a most preferred embodiment, the bolt may be generally tangential to the annular base. In an alternative embodiment, the bolt may be generally radial relative to the annular base. In a further alternative embodiment, the bolt may be axial to the annular base, or offset relative to an axial direction.

It is preferred that the bearing member includes an internally threaded body portion arranged to engage with threads on the bolt. It is preferred that the body portion is integral with an engaging portion of the bearing member, the engaging portion including the bearing surface.

The bearing member may include two engaging members, each of which has a body portion and an engaging portion. In a preferred embodiment, the body portion of only one engaging member is internally threaded. The two engaging members may be separated by a resilient biasing means such as a spring, which may act to bias the engaging members away from each other.

Alternatively, the bearing member may be arranged to pivot between the first configuration and the second configuration.

According to a fourth aspect of the present invention there is provided a swiveling joint including a first member, a second member, and a bearing member;

the first member being associated with a first leg, the first leg having a longitudinal direction, the first member having a hollow body portion, the first member having a bearing surface which is oriented at an acute angle relative to the longitudinal direction of the first leg, the bearing surface facing towards the hollow body portion;

the second member being associated with a second leg, the second leg having a longitudinal direction;

the bearing member being connected to the second member by an adjustable connection means, the bearing member having a bearing surface which is oriented at an acute angle relative to the longitudinal direction of the first leg;

the bearing member locating within the hollow body portion of the first member, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

The bearing surface of the first member may be annular. It may be formed as an annular shoulder at an outer edge of the hollow body portion.

The bearing member may be annular. In one embodiment, the bearing surface of the bearing member is an outer annular ring of the bearing member. The bearing member may include connection means receiving apertures located internally of the outer annular ring.

The connection means receiving apertures may be internally threaded. The connection means may be formed by a plurality of externally threaded bolts arranged to be received within the receiving apertures.

The bolts may be angularly spaced around the swiveling joint. In one embodiment the connection means may be formed by three such bolts, spaced apart by 120°.

The bolts may be perpendicular to the bearing surfaces. In one embodiment, the bolts are off-set by an acute angle, preferably between 15° and 30°, such as 22.5°, from the perpendicular. In this embodiment, the bearing member may include an annular connection means receiving portion having a face which is frusto conical, with an obtuse cone angle, such as 135°.

In a preferred form of this embodiment, one of the first member and the second members has a circular recess, and the other of the first member and the second member has a circular projection arranged to locate within the circular recess, and the adjustable connection means passes within the circular projection.

The swiveling joint may include secondary apertures in the first member and the second member, arranged to receive a secondary locking pin. The secondary apertures may be formed as recesses extending inwardly from an outer periphery in at least one of the first and second members.

According to a fifth aspect of the present invention there is provided a swiveling joint including a first member, a second member, and a bearing member;

the first member being associated with a longitudinally extending first leg, the first leg having a longitudinal direction, the first member having a hollow body portion, the first member having a bearing surface which is oriented at an acute angle relative to the longitudinal direction of the first leg, the bearing surface facing towards the first leg;

the second member being associated with a longitudinally extending second leg, the second leg having a longitudinal direction;

the first member and the second member being arranged to meet along a connection annulus, the bearing member being connected to the second member by an adjustable connection means, the bearing member having a bearing surface which is oriented at an acute angle relative to the longitudinal direction of the first leg;

the bearing member locating inside the connection annulus, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

It is preferred that the joint can be rotated into a main orientation wherein the respective longitudinal axes of the first and second legs are parallel. It is further preferred that, in this orientation, a void is defined around a central axis of the joint. Advantageously, this allow cables and similar items to locate centrally along the central axis.

It is preferred that rotation of the first member relative to the second member occurs about an axis of rotation which is disposed at an acute angle relative to the longitudinal axis of the first leg.

The acute angle may be between 30° and 60°, and is most preferably about 450.

The swiveling joint may be usefully deployed in an elongate member for locating articles remote from a base position. It is considered that it may be useful in an elongate member having length of at least 1.5m, and particularly if length exceeds 2m. The elongate member may be a light pole.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
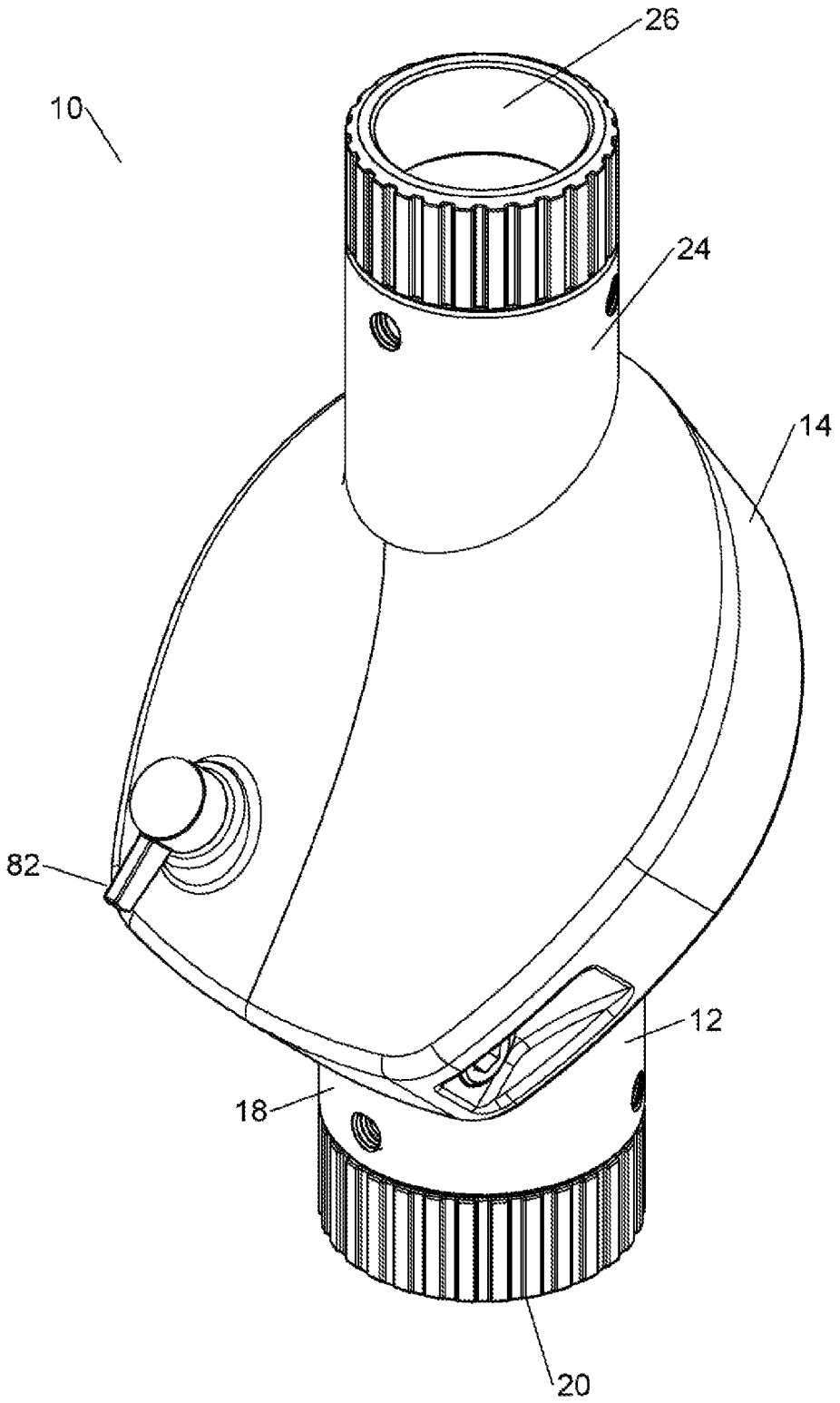
FIG. 1 is a perspective of a swiveling joint in accordance with a first embodiment of the present invention, shown in a first position.
Figure 2:
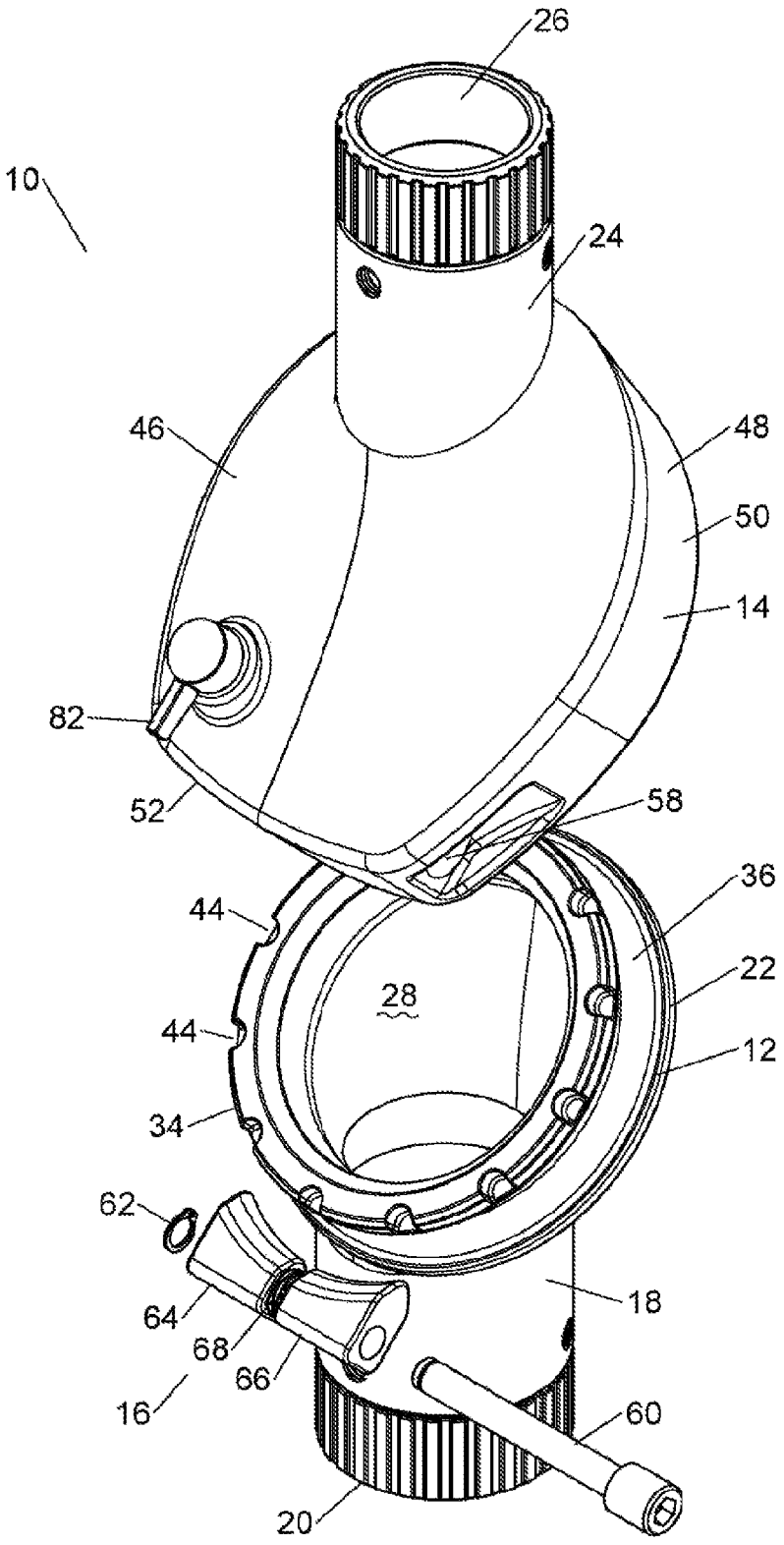
FIG. 2 is a front exploded view of the swiveling joint of FIG. 1.

A first embodiment of the present invention will be described with reference to FIGS. 1 to 10, in which there is shown a swiveling joint 10 having three main components: a first member 12, a second member 14 and a bearing member 16.

The first member 12 is associated with a first leg 18, which is oriented in a longitudinal direction. The first leg 18 terminates at a pole receiving aperture 20, which forms a cylindrical sleeve arranged to connect to a pole (such as the base of a light pole) by suitable means such as clamping or welding.

The second member 14 is associated with a second leg 24, which is oriented in a longitudinal direction. The second leg 24 terminates at a pole receiving aperture 26, which forms a cylindrical sleeve arranged to connect to a pole (such as the top portion of a light pole) by suitable means such as clamping or welding.

The arrangement is such that when the swiveling joint 10 is in a first position, as shown in FIG. 1, the first leg 18 and the second leg 24 can both be vertical, and aligned along a common longitudinal axis.

The first member 12 has an annular base 22 which is connected to the first leg 18 by means of a tapered connection portion 28.

The annular base 22 defines a plane oriented at an angle relative to the longitudinal axis of the first leg 18. The angle of orientation may be considered by defining an offset angle between the longitudinal axis of the first leg 18, and a line perpendicular to the plane of the base 22. The offset angle is an acute angle. In the embodiment shown, the offset angle is 45°.

The annular base 22 is circular, with a diameter nearly twice that of the first leg 18. The annular base 22 is positioned such that a lower side 30 is close to a nominal cylinder defined by the first leg 18, and an upper side 32 is spaced from this nominal cylinder.

The first member 12 has an annular outer rim 34 which is parallel to, and spaced from, the base 22. The outer rim 34 is circular, with a diameter similar to that of the base 22. The base 22 and the outer rim 34 are aligned along a common offset axis, which is oriented at the offset angle relative to the longitudinal axis.

The arrangement is such that an upper side of the outer rim 34 is close to the nominal cylinder defined by the first leg 18.

An annular groove 36 is located between the base 22 and the outer rim 34. The annular groove 36 is 'flat-bottomed-V' shaped in cross section. In other words, the annular groove 36 is formed by an inwardly tapering lower frusto conical surface 38, a cylindrical inner surface 40, and an outwardly tapering upper frusto conical surface 42. The lower frusto conical surface 38 extends between the base 22 and the inner surface 40, and the upper frusto conical surface 42 extends between the inner surface 40 and the outer rim 34. The cylindrical inner surface 40 is aligned along the offset axis, with a diameter about 90% that of the outer rim 34. The annular groove may alternatively be 'curve-bottomed-V' shaped in cross section, with the inner surface being partly toroidal rather than cylindrical.

The outer rim 34 has a plurality of recesses 44 spaced around its upper periphery. In the embodiment shown there are 12 recesses equally spaced around the outer rim 34.

The second member 14 has an upper face 46 extending away from the second leg 24. The upper face 46 is broadly located in and around a plane oriented at an offset angle relative to the longitudinal axis of the second leg 24. The offset angle of the upper face 46 is similar to that of the base 22; about 45° in this embodiment.

An outer wall or skirt 48 depends from the upper face 46 in a direction generally perpendicular to the upper face 46. The skirt 48 includes an approximately part-cylindrical portion 50 extending around approximately 280°, and a flattened edge 52 at a lower end of the skirt 48, spaced from the second leg 24.

The skirt 48 is sized to locate around the annular base 22 of the first member 12.

Figure 3:
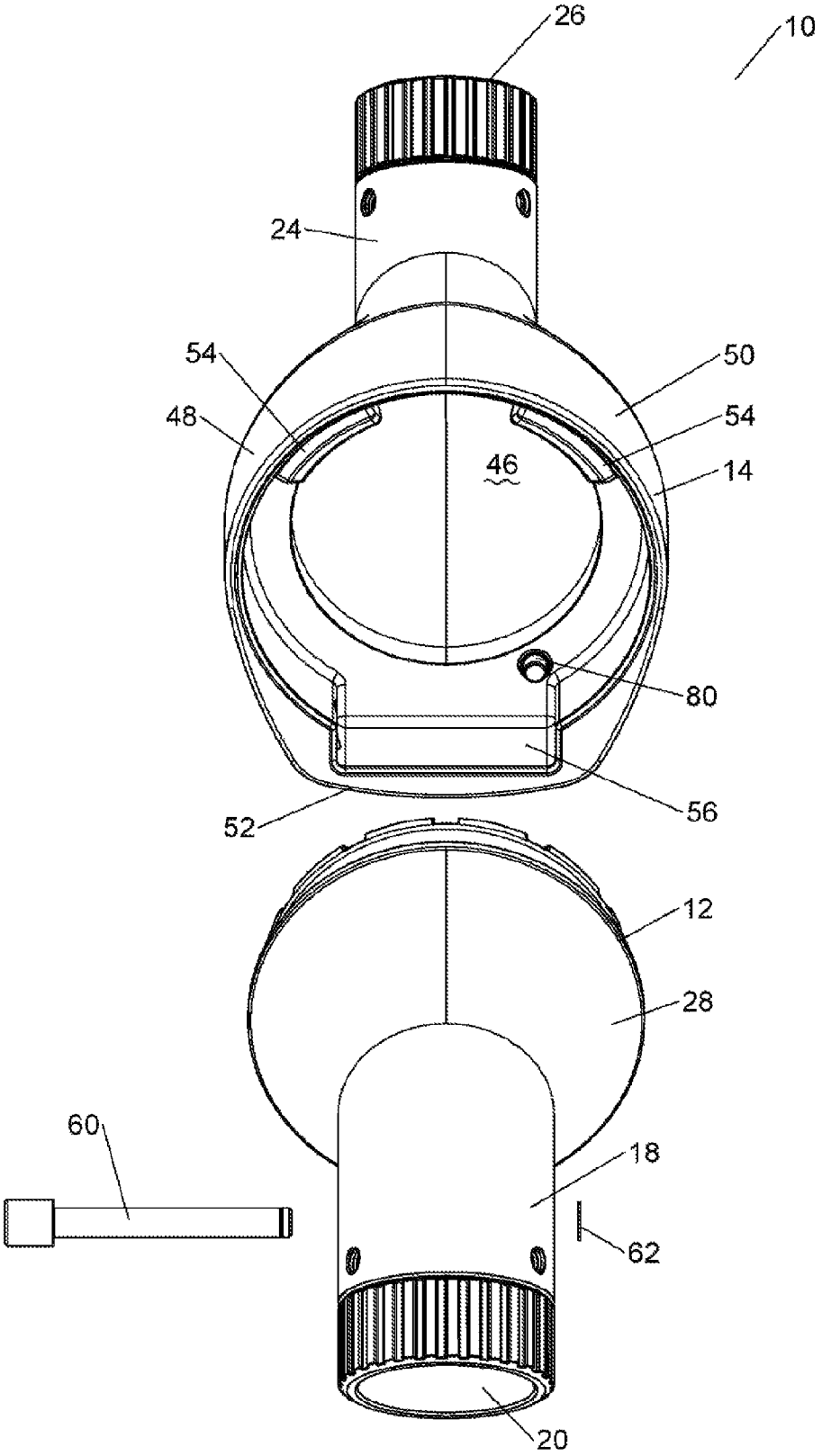
FIG. 3 is a rear exploded view of the swiveling joint of FIG. 1.
Figure 4:
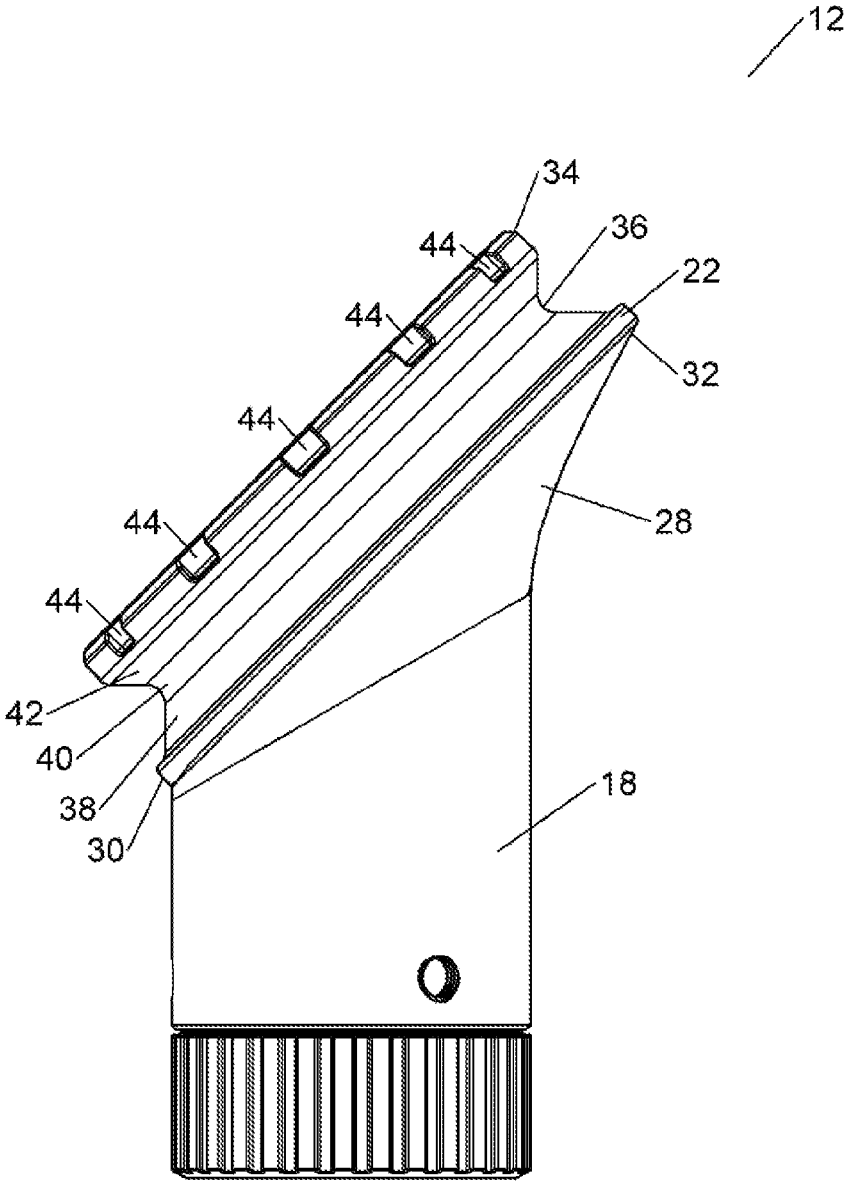
FIG. 4 is a side view of a first member within the swiveling joint of FIG. 1.
Figure 5:
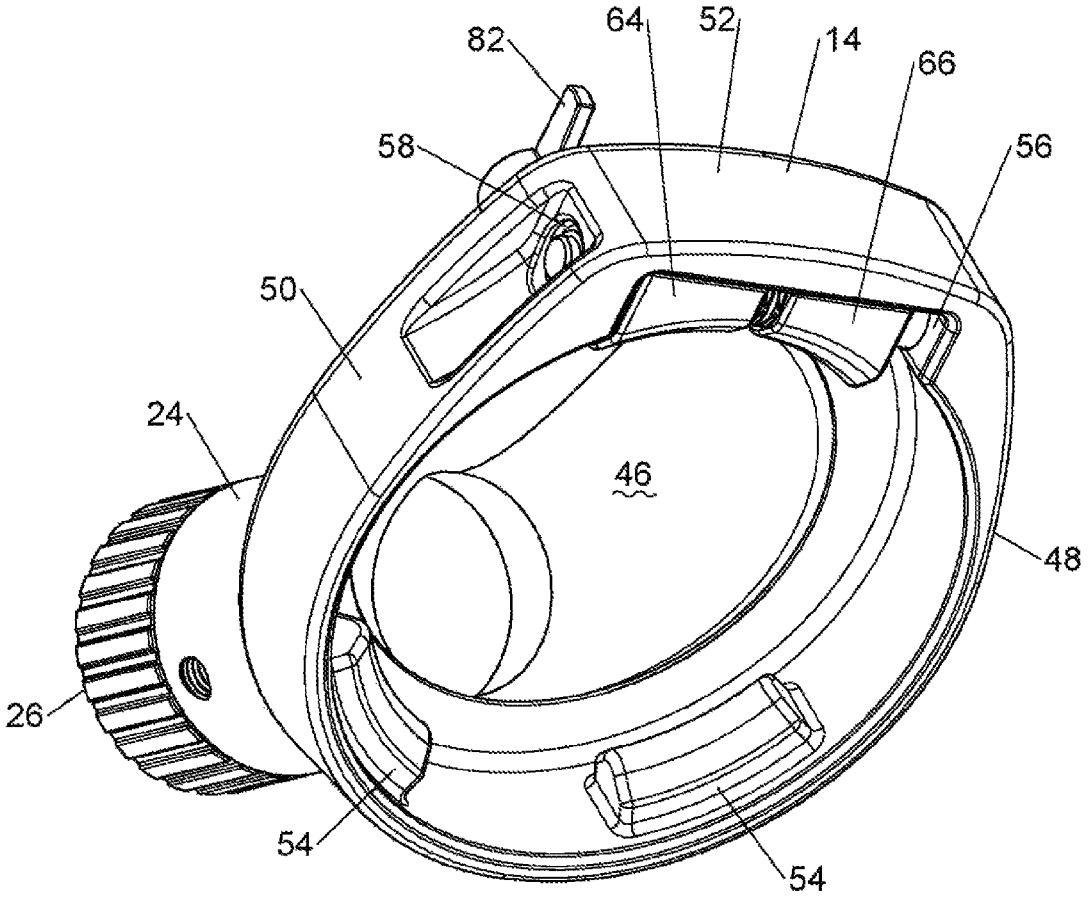
FIG. 5 is a lower perspective of a second member within the swiveling joint of FIG. 1.
Figure 6:
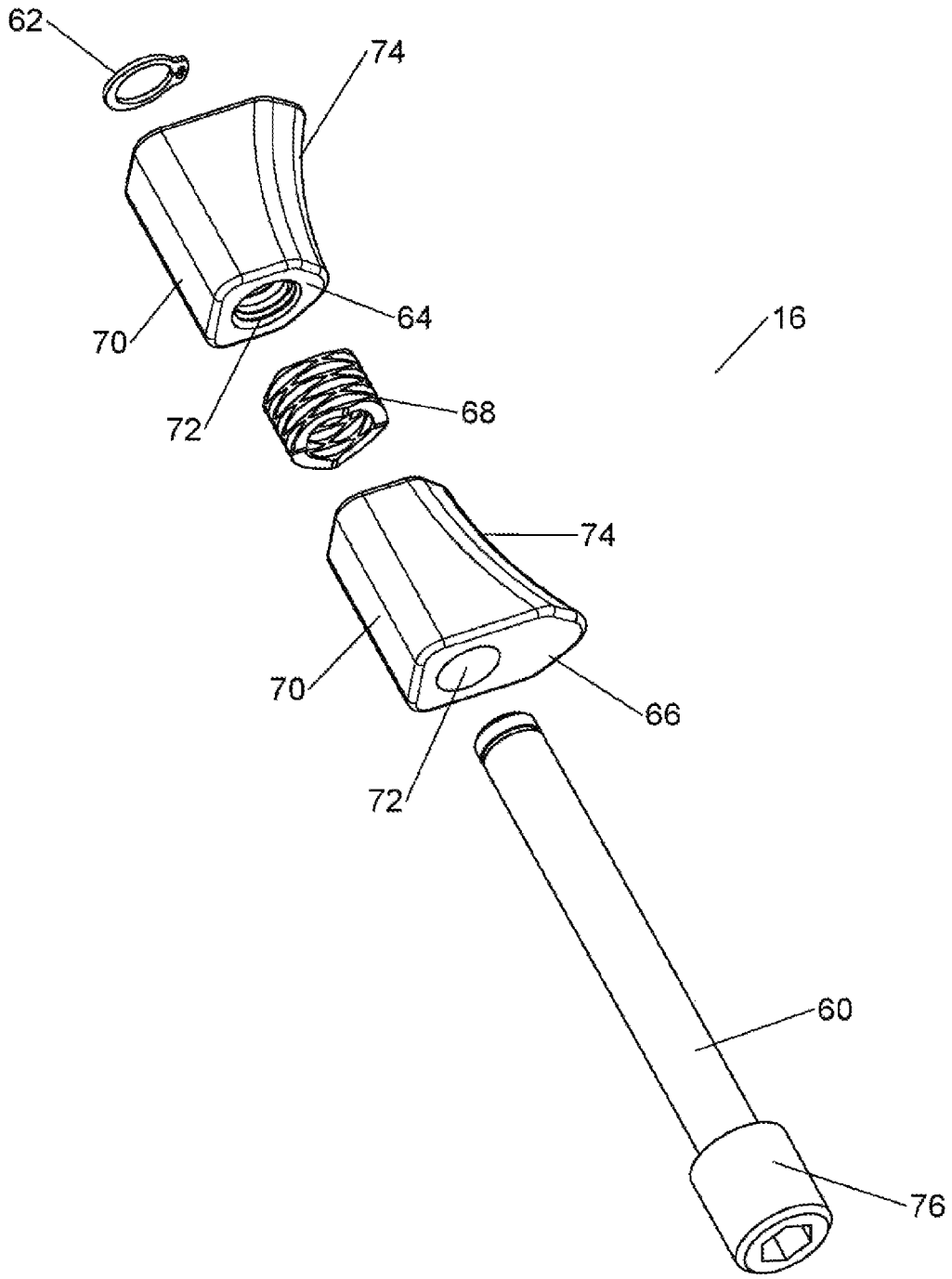
FIG. 6 is an exploded view of a clamping member within the swiveling joint of FIG. 1.

The interior of the second member 14 can be seen in FIGS. 3 and 5. The skirt 48 includes two inwardly extending projections 54, located near the second leg 24. The two inwardly extending projections 54 have centres spaced from each other by about 90° around the part-cylindrical portion 50, with each about 45° from an upper end of the skirt 48. The inwardly extending projections are each aligned circumferentially around the part-cylindrical portion 50, with each projection 54 extending along about 45°.

The skirt 48 also includes a bearing member receiving portion 56 located internally of the flattened edge 52. The bearing member receiving portion 56 is broadly rectangular in shape, oriented tangentially to a nominal cylinder defined by the part-cylindrical portion 50. The bearing member receiving portion 56 has bolt receiving apertures 58 at outer ends thereof.

The bearing member 16 is sized and shaped to locate within the bearing member receiving portion 56. The bearing member 16 includes a bolt 60, sized to extend through the bearing member receiving portion in a direction parallel to the flattened edge 52; a retaining clip 62 arranged to locate in a groove around a distal end of the bolt 60; a first engaging member 64, a second engaging member 66, and a separating spring 68.

The first engaging member 64 has a body portion 70 through which an internally threaded aperture 72 extends in a longitudinal direction. The body portion 70 has a length approximately one-third that of the bearing member receiving portion 56. The internally threaded aperture is arranged to engage with external threads on the bolt 60.

The first engaging member 64 has an engaging portion 74 located on an inner side of the body portion. The engaging portion 74 is concave in shape, with a radius of curvature similar to that of the inner surface 40 of the annular groove 36 of the first member 12. The engaging portion 74 is arranged to locate within the annular groove 36 as will be described below.

The second engaging member 66 is similar to the first engaging member 64, with the principal difference being that the aperture 72 extending through the body portion 70 of the second engaging member is not internally threaded.

The bolt 60 has a head 76 at a proximal end thereof.

For ease of explanation, assembly of the bearing member 16 will be described with reference to the second member 14 only. The bearing member 16 can be assembled directly within the second member 14 as follows. The first engaging member 64 is positioned within the bearing member receiving portion 56, with its aperture 72 aligned with the apertures 58 of the bearing member receiving portion 56, and its engaging portion 74 oriented to generally follow the curvature of the part cylindrical portion of the skirt 48. The first engaging member 64 is located towards one side of the bearing member receiving portion 56.

The second engaging member 66 is located within the bearing member receiving portion 56, in a mirror-image position to the first engaging member 64. The second engaging member 66 is located towards the other side of the bearing member receiving portion 56.

The separating spring 68 is positioned between the first and second engaging members 64, 66.

The bolt 60 is passed sequentially through a first bolt receiving aperture 58, the aperture 72 of the second engaging member 66, the separating spring 68, the aperture 72 of the first engaging member 64 (through which it must be threaded), and the second bolt receiving aperture 58. The retaining clip is then placed onto the bolt 60 outside the second bolt receiving aperture 58, preventing inadvertent withdrawal of the bolt 60 back through the second bolt receiving aperture 58. The head 76 of the bolt remains outside the first bolt receiving aperture 58.

It will be appreciated that the action of the spring 68 is to urge the second engaging member 66 towards a side wall of the bearing member receiving portion 56, adjacent the first bolt receiving aperture 58. The axial position of the first engaging member 64, and thus the distance between the first and second engaging members 64, 66, is altered by rotation of the bolt 60.

The swiveling joint 10 is assembled by location of the second member 14 and bearing member 16 about the first member 12. The ultimate arrangement is such that the skirt 48 of the second member 14 sits over the first member 12, with the inward projections 54 and the engaging portions 74 of the bearing member 16 locating within the annular groove 36. In other words, the skirt 48 seats over the base 22 of the first member in a sliding fit, defining an exterior surface of the swiveling joint 10. Other than the head 76 of the bolt 60, and the retaining clip 62, the working parts of the bearing member 16 are located internally of the swiveling joint 10. In particular, it will be appreciated that the bearing surfaces, being the engaging portions 74 and the annular groove 36, sit internally of the exterior surface and are generally protected from water and dust ingress.

Figure 7:
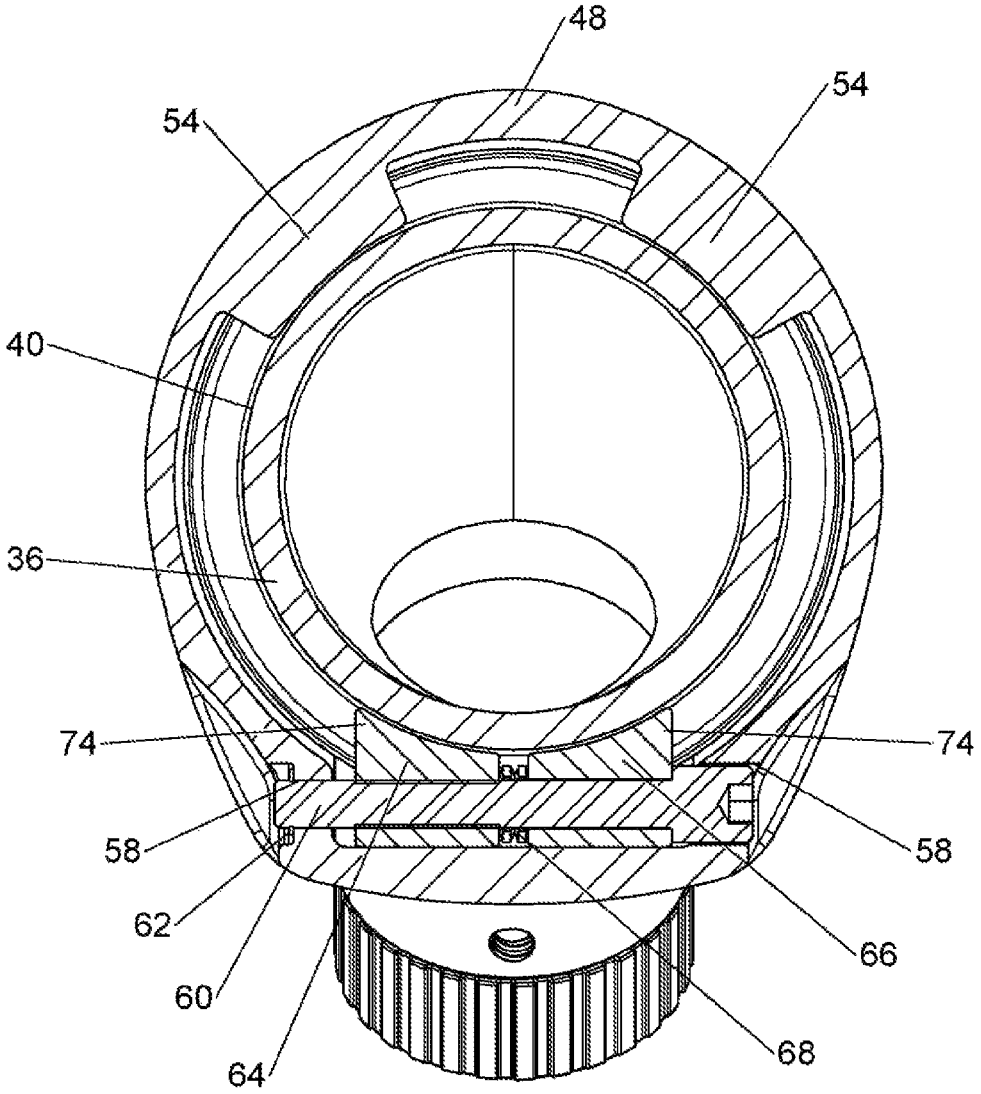
FIG. 7 is a cross sectional view taken through an angle of action of the swiveling joint of FIG. 1.

This arrangement can be seen in cross section in FIG. 7.

In order to assemble the swiveling joint 10, it is first necessary to place the first and second engaging members 64, 66 and separating spring 68 within the annular groove 36 of the first member 12, at the lower side 30 thereof. The first and second engaging members 64, 66 and separating spring 68 can be held there manually, or by use of a suitable removable clip.

The second member 14 can then be placed over the first member 12 by locating the inward projections 54 within the groove 36 at the upper side 32 thereof, and using these as hinges then closing the second member 14 over the first member 12, with the flattened edge 52 of the skirt 48 lowering over the first and second engaging members 64, 66.

Once the second member 14 has been lowered into position, the bolt 60 can be placed into position to effectively mount the first and second engaging members 64, 66 to the second member 14.

Once the swiveling joint has been thus assembled, rotation of the second member 14 relative to the first member 12 can be selectively permitted or prevented by rotation of the bolt 60.

When the bolt 60 is tightened, the first engaging member 64 is brought towards the second engaging member 66. This acts to reduce the effective radius of curvature, and urges the engaging portions 74 into engagement with the annular groove 36. Tightening of the bolt 60 provides a wedging effect, with the engaging portions 74 clamping against the annular groove 36 and the annular groove 36 being forced in turn against the inward projections 54. The resulting friction is sufficient to maintain the swivelling joint 10 in a desired position, with rotation substantially prevented. This can be seen in cross section in FIG. 8.

Figure 8:
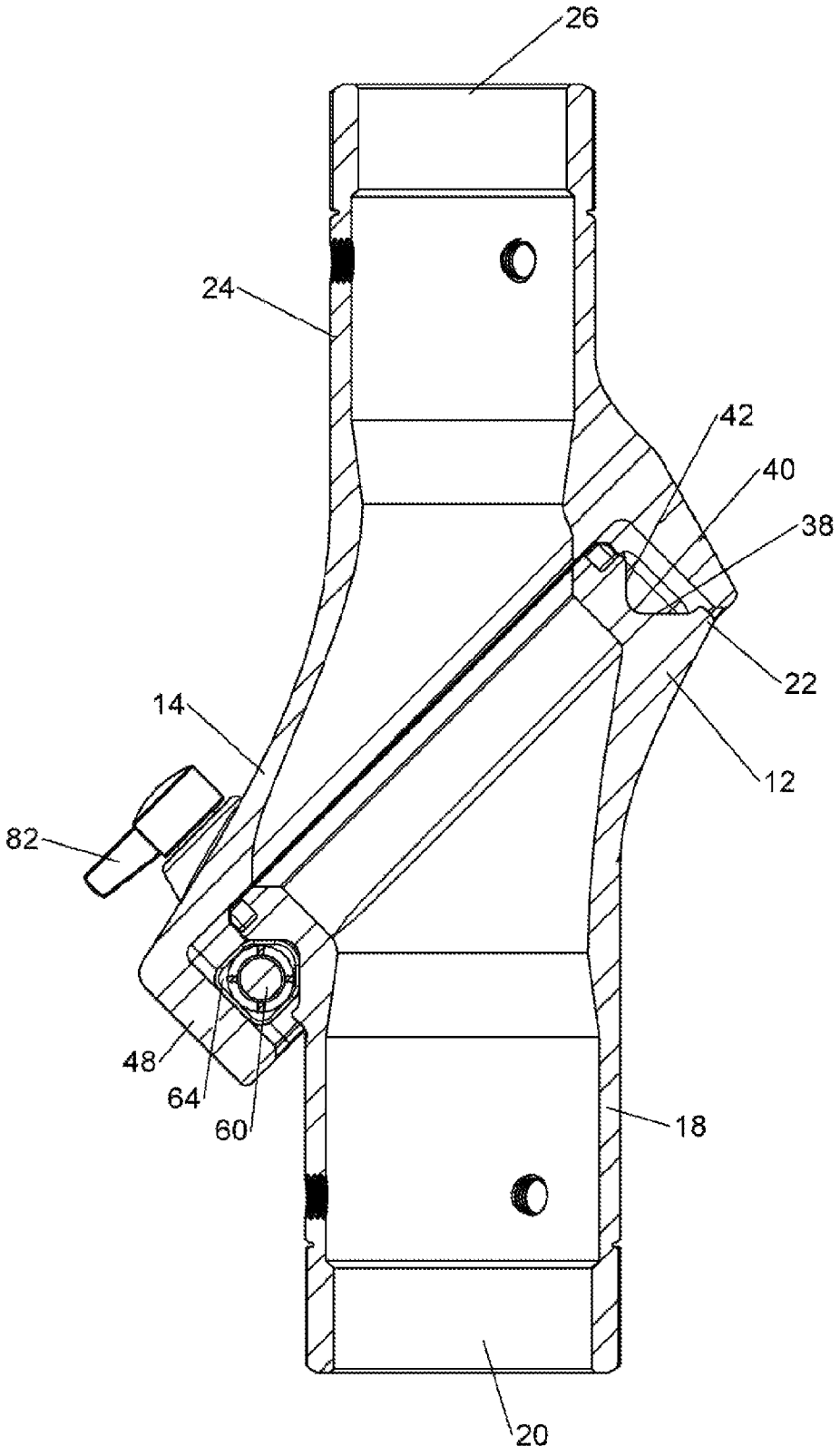
FIG. 8 is a cross sectional view taken from the side of the swiveling joint of FIG. 1.
Figure 9:
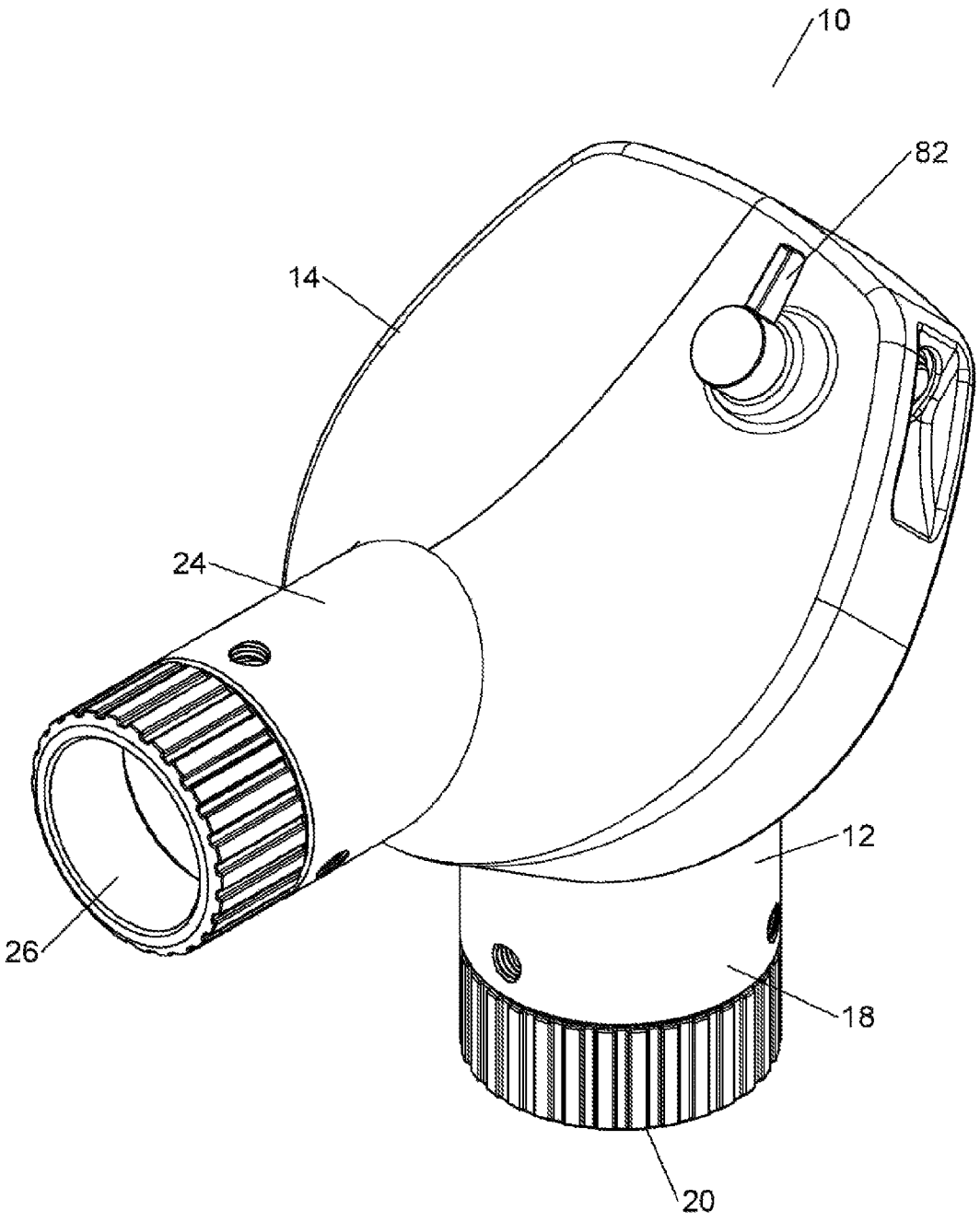
FIG. 9 is a perspective of the swiveling joint of FIG. 1, shown in a second position.
Figure 10:
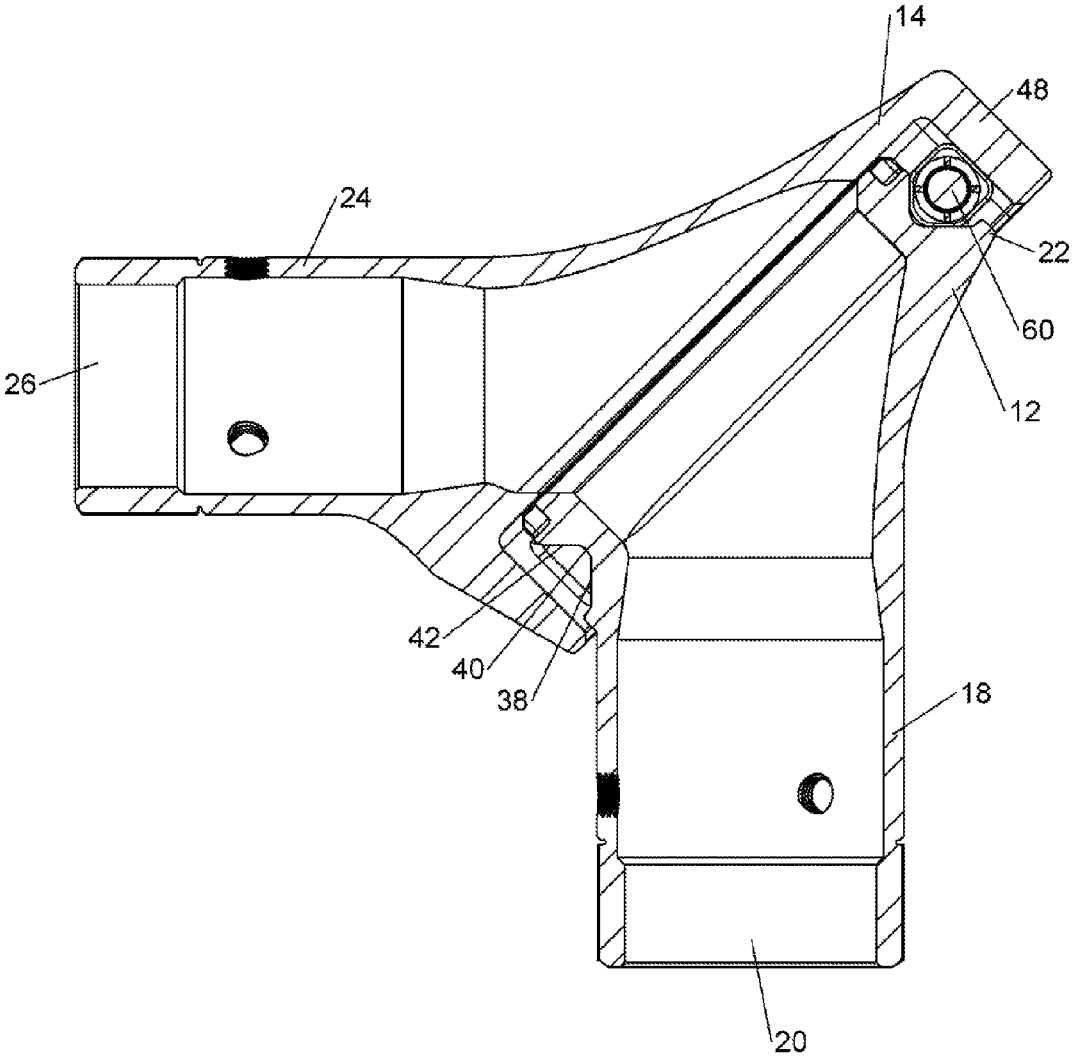
FIG. 10 is a cross sectional view taken from the side of the swiveling joint in the position of FIG. 9.

When the bolt 60 is loosened, the opposite effect takes place. The engaging portions 74 are released from active engagement with the annular groove 36, and the annular groove 36 is no longer forced against the inward projections 54. Rotation of the second member 14 relative to the first member 12 about the offset axis is now permitted. The engaging portions 74 and inward projections 54 remain located within the annular groove 36, preventing complete disconnection of the second member 14 from the first member 12. The swiveling joint can be rotated from its first position, where the first leg 18 and the second leg 24 are substantially parallel as shown in FIGS. 1 and 8, to a second position, where the first leg 18 and the second leg 24 are substantially perpendicular as shown in FIGS. 9 and 10. It will be appreciated that the joint can be rotated into any intermediate position between the first and second positions. During rotation the skirt 48 of the second member 14 stays surrounding an outer periphery of the annular base 22 of the first member 12. In this way, the skirt 48 and the base 22 combine to form a generally circular track about which rotation occurs.

It will be appreciated that the first position of the joint 10, where the first leg 18 and the second leg 24 are substantially parallel, represents the main orientation of the joint 10. As seen in FIG. 8, in this orientation there is a generally cylindrical hollow void passing through the centre of the joint 10 in this orientation. In practice, this void is likely to have electrical cabling passing through it. It is considered a significant advantage of the present invention that this cabling is not obstructed by any mechanical linkages passing though the void.

The swiveling joint 10 includes a secondary locking means, provided by a locking pin 80 mounted to the upper face 46 of the second member 14. The locking pin 80 is moveable by operation of a lever 82 between a first position in which the locking pin 80 extends, in use, into a recess 44 in the outer rim 34 of the first member 12; and a second position in which the locking pin 80 is retracted towards the upper face 46, and is not in engagement with the first member 12.

A second embodiment of the present invention will be described with reference to FIGS. 11 to 17, in which there is shown a swiveling joint 110 having three main components: a first member 112, a second member 114 and a bearing arrangement formed by three bearing members 116.

The first member 112 is associated with a first leg 118, which is oriented in a longitudinal direction. The first leg 118 terminates at a pole receiving aperture 120, which forms a cylindrical sleeve arranged to connect to a pole (such as the base of a light pole) by suitable means such as clamping or welding.

The second member 114 is associated with a second leg 124, which is oriented in a longitudinal direction. The second leg 124 terminates at a pole receiving aperture 126, which forms a cylindrical sleeve arranged to connect to a pole (such as the top portion of a light pole) by suitable means such as clamping or welding.

Figure 11:
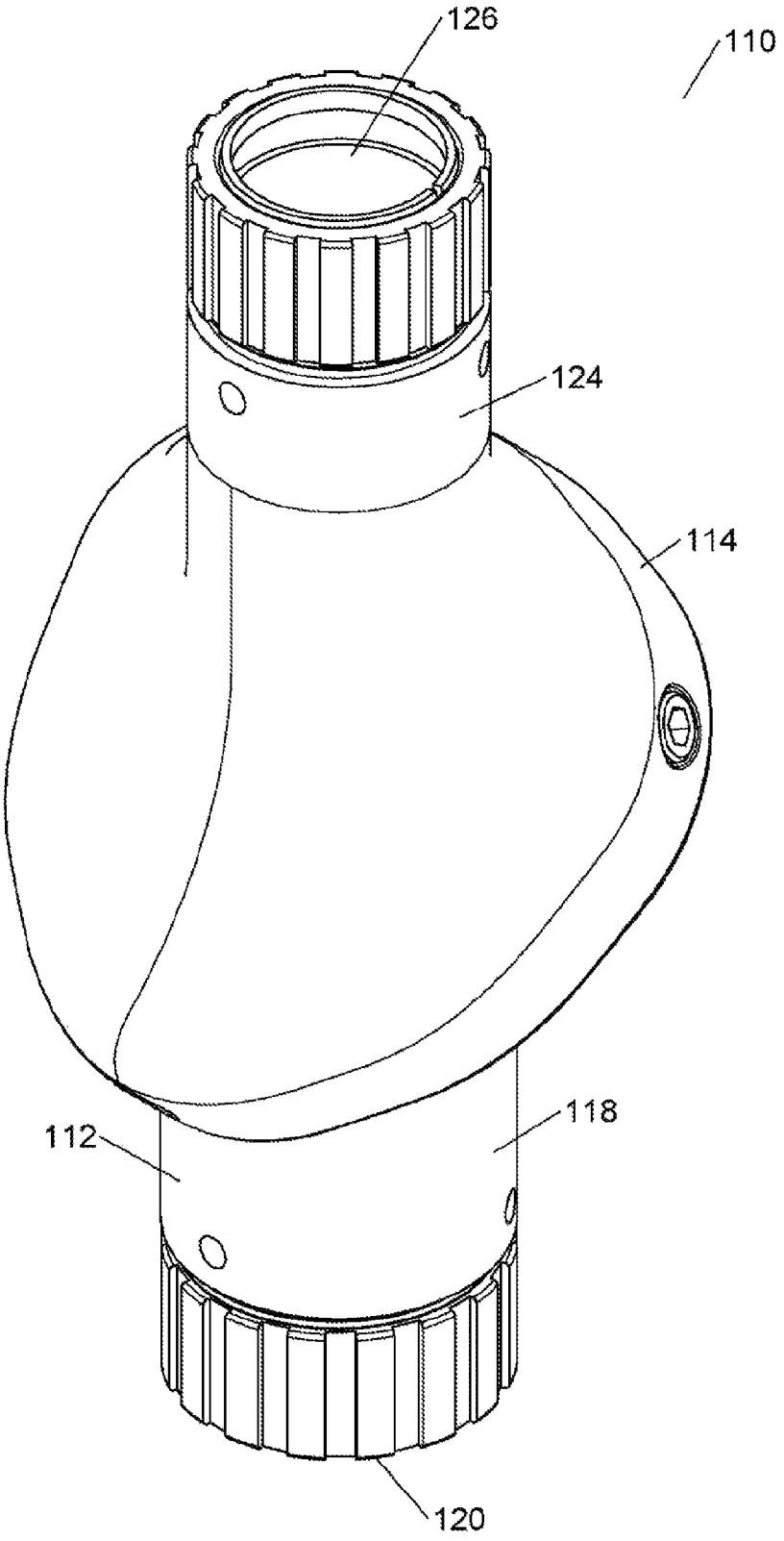
FIG. 11 is a perspective of a swiveling joint in accordance with a second embodiment of the present invention, shown in a first position.
Figure 12:
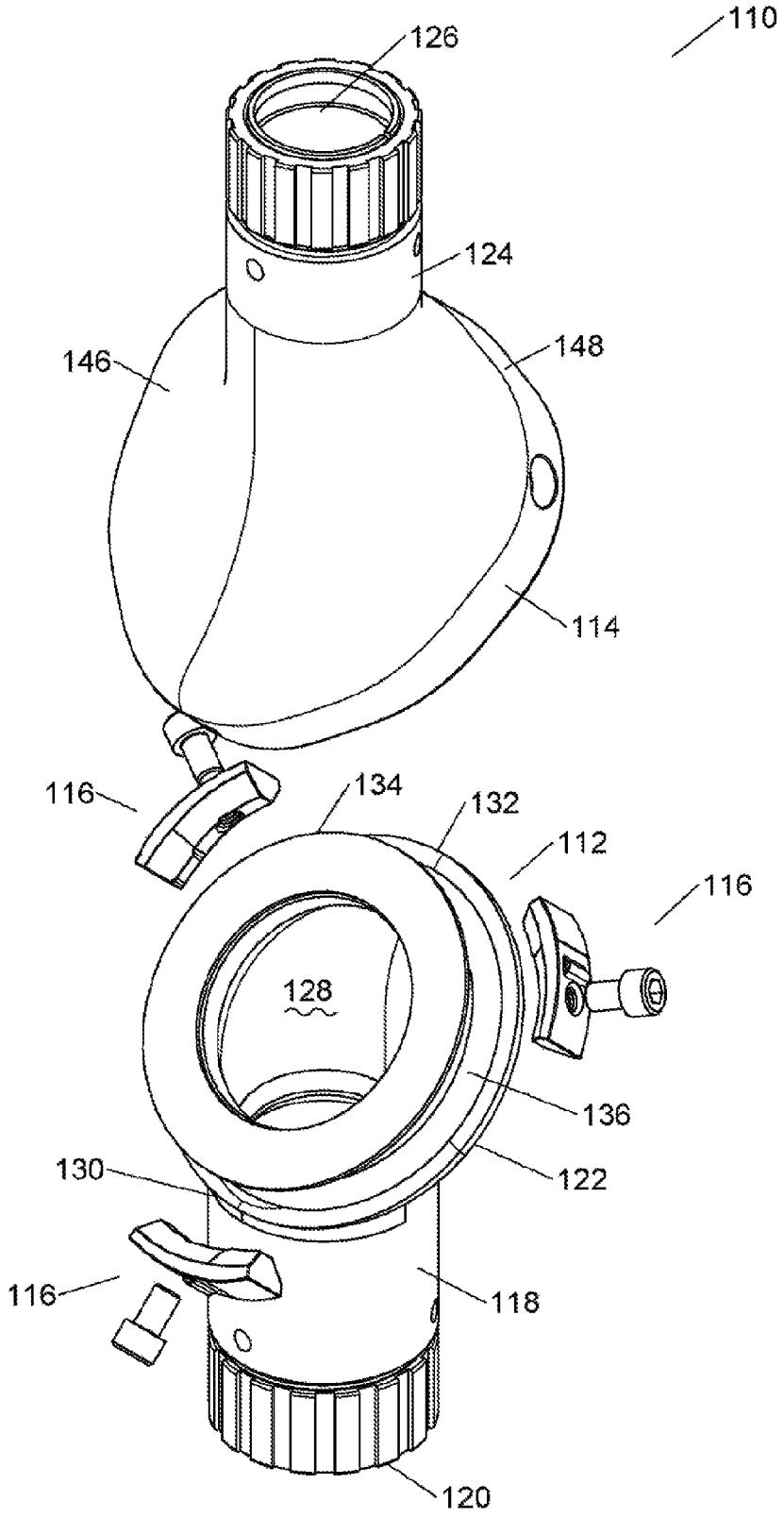
FIG. 12 is a front exploded view of the swiveling joint of FIG. 11.
Figure 13:
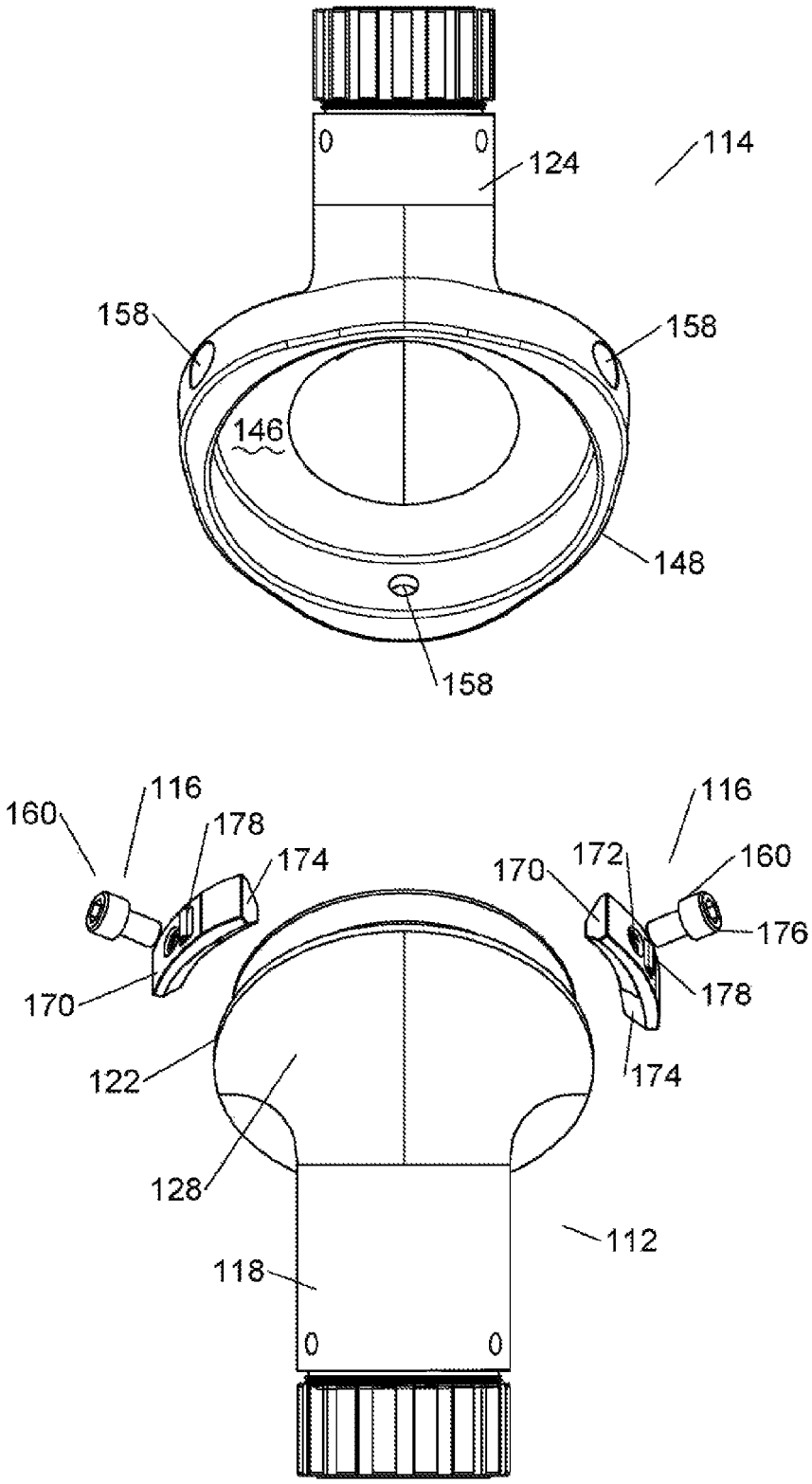
FIG. 13 is a rear exploded view of the swiveling joint of FIG. 11.

The arrangement is such that when the swiveling joint 110 is in a first position, as shown in FIG. 11, the first leg 118 and the second leg 124 can both be vertical, and aligned along a common longitudinal axis.

The first member 112 has an annular base 122 which is connected to the first leg 118 by means of a tapered connection portion 128.

The annular base 122 defines a plane oriented at an offset angle relative to the longitudinal axis of the first leg 118. The offset angle is an acute angle. In the embodiment shown, the offset angle is 45°.

The annular base 122 is circular, with a diameter nearly twice that of the first leg 118. The annular base 122 is positioned such that a lower side 130 is close to a nominal cylinder defined by the first leg 118, and an upper side 132 is spaced from the nominal cylinder.

The first member 112 has an annular outer rim 134 which is parallel to, and spaced from, the base 122. The outer rim 134 is circular, with a diameter similar to that of the base 122. The base 122 and the outer rim 134 are aligned along a common offset axis, which is oriented at the offset angle relative to the longitudinal axis.

The arrangement is such that an upper side of the outer rim 134 is close to the nominal cylinder defined by the first leg 118.

An annular groove 136 is located between the base 122 and the outer rim 134. The annular groove 136 is 'flat-bottomed-V' shaped in cross section. In other words, the annular groove 136 is formed by an inwardly tapering lower frusto conical surface 138, a cylindrical inner surface 140, and an outwardly tapering upper frusto conical surface 142. The lower frusto conical surface 138 extends between the base 122 and the inner surface 140, and the upper frusto conical surface 142 extends between the inner surface 140 and the outer rim 134. The cylindrical inner surface 140 is aligned along the offset axis, with a diameter about 90% that of the outer rim 134.

The second member 114 has an upper face 146 extending away from the second leg 124. The upper face 146 is broadly located in and around a plane oriented at an offset angle relative to the longitudinal axis of the second leg 124. The offset angle of the upper face 146 is similar to that of the base 122; about 45° in this embodiment.

An outer wall or skirt 148 depends from the upper face 146 in a direction generally perpendicular to upper face 146. The skirt 148 is generally cylindrical in shape.

The skirt 148 is sized to locate around the annular base 122 of the first member 112.

Figure 14:
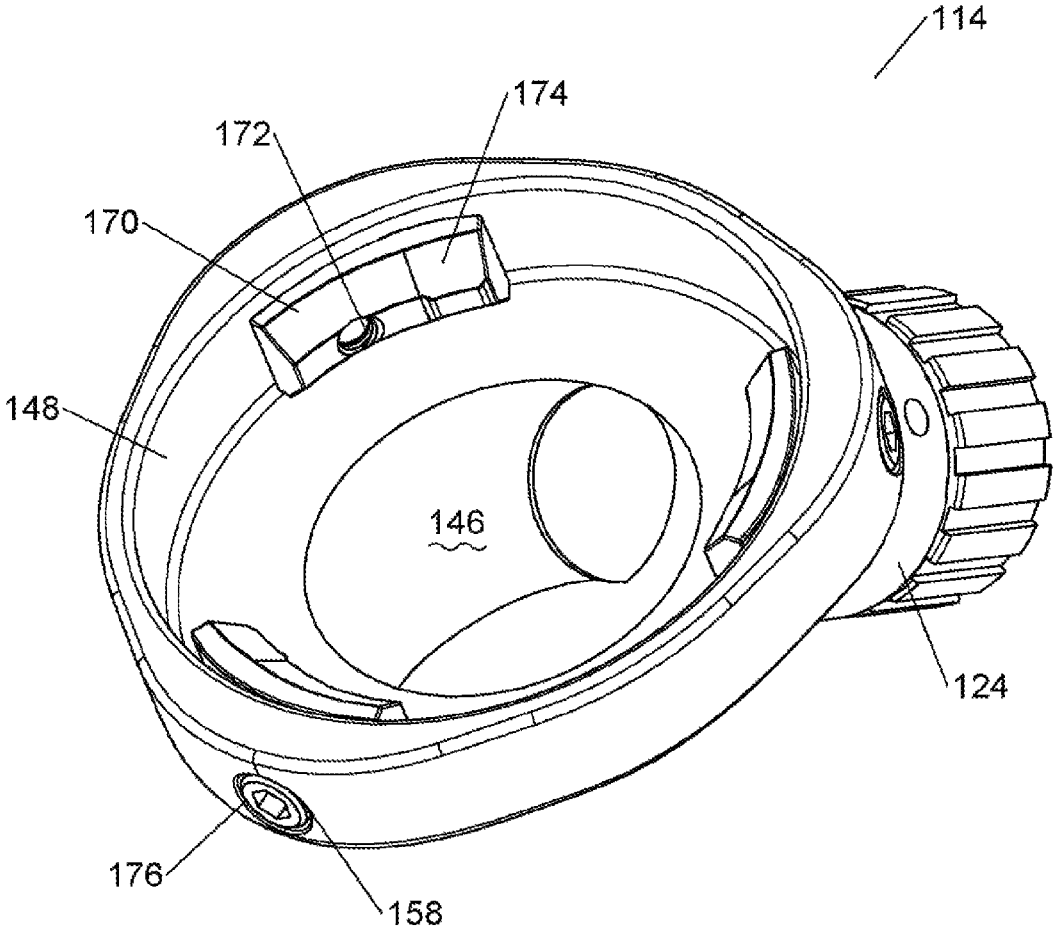
FIG. 14 is a lower perspective of a second member within the swiveling joint of FIG. 11.

The interior of the second member 114 can be seen in FIG. 14. The skirt 114 has a generally cylindrical inner surface, with three bolt receiving apertures 158 spaced at equal distances about the circumference of the skirt 148. The bolt receiving apertures 158 are counter sunk.

Each bearing member 116 is sized and shaped to locate within the annular groove 136. Each bearing member 116 includes a bolt 160, sized to extend through the bearing member 116, a body portion 170 through which an internally threaded aperture 172 extends, an engaging portion 174 spaced from the internally threaded aperture 172, and a raised portion 178 adjacent the internally threaded aperture 172. The engaging portion 174 and the raised portion 178 are on opposite sides of the body portion 170. The internally threaded aperture 172 is arranged to engage with external threads on the bolt 160.

Each bolt 160 has a head 176 arranged to locate within the outer part of a bolt receiving aperture 158.

The swiveling joint 110 is assembled by location of the second member 114 and bearing members 116 about the first member 112. The ultimate arrangement is such that the skirt 148 of the second member 114 sits over the first member 112, with the engaging portions 174 of the bearing members 116 locating within the annular groove 136.

Figure 15:
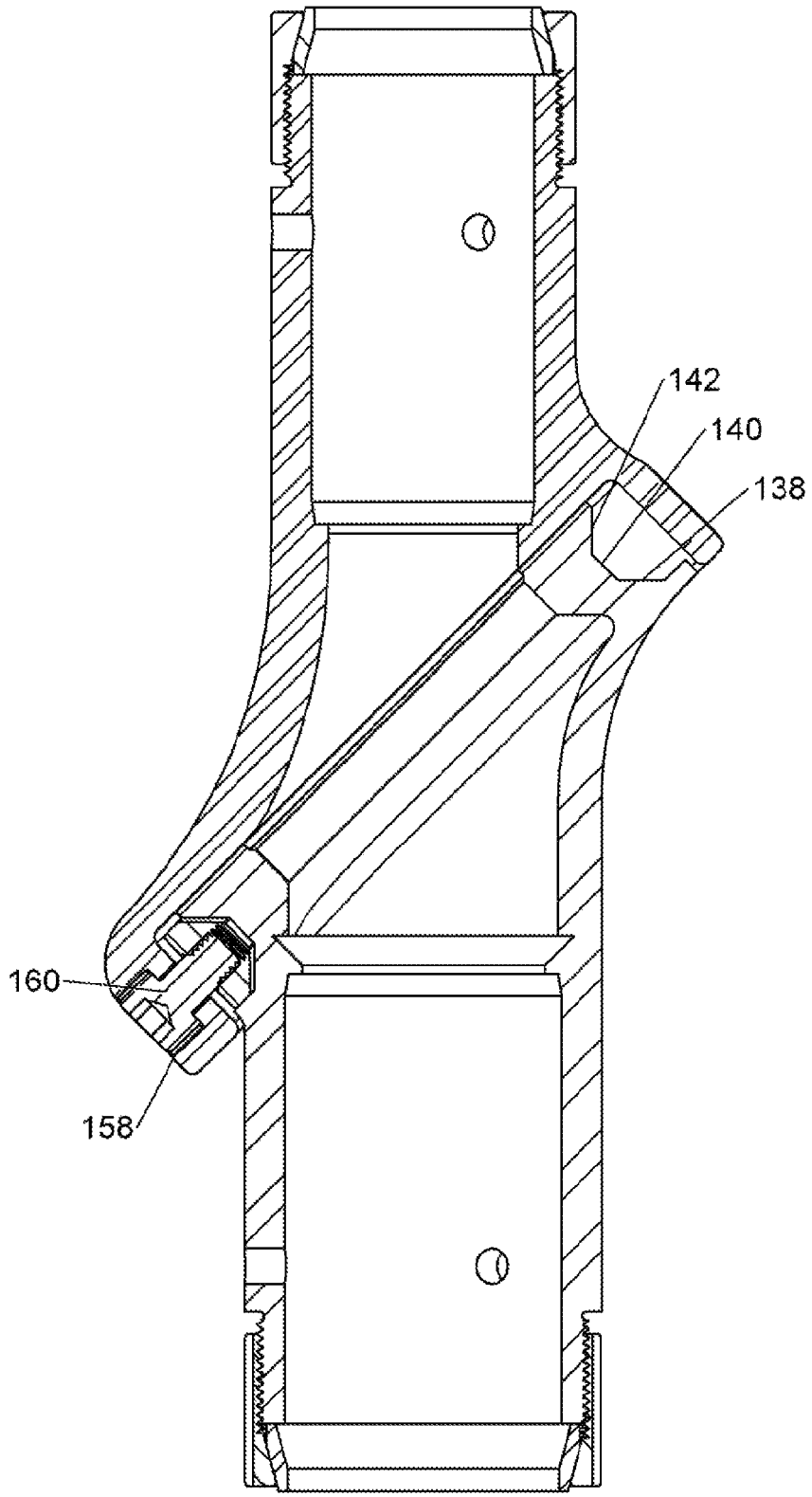
FIG. 15 is a side cross sectional view of the swiveling joint of FIG. 11.

This arrangement can be seen in cross section in FIG. 15.

In order to assemble the swiveling joint 110, it is first necessary to place the body portions 170 of the three bearing members 116 at appropriate locations within the annular groove 136 of the first member 112. The body portions 170 can be held there manually, or by use of a suitable removable clip.

The second member 114 can then be placed over the first member 112.

Once the second member 114 has been lowered into position, the bolts 160 can be placed into position to effectively mount the body portions 170 of the bearing members 116 to the second member 114.

Once the swiveling joint has been thus assembled, rotation of the second member 114 relative to the first member 112 can be selectively permitted or prevented by rotation of the bolts 160.

Figure 16:
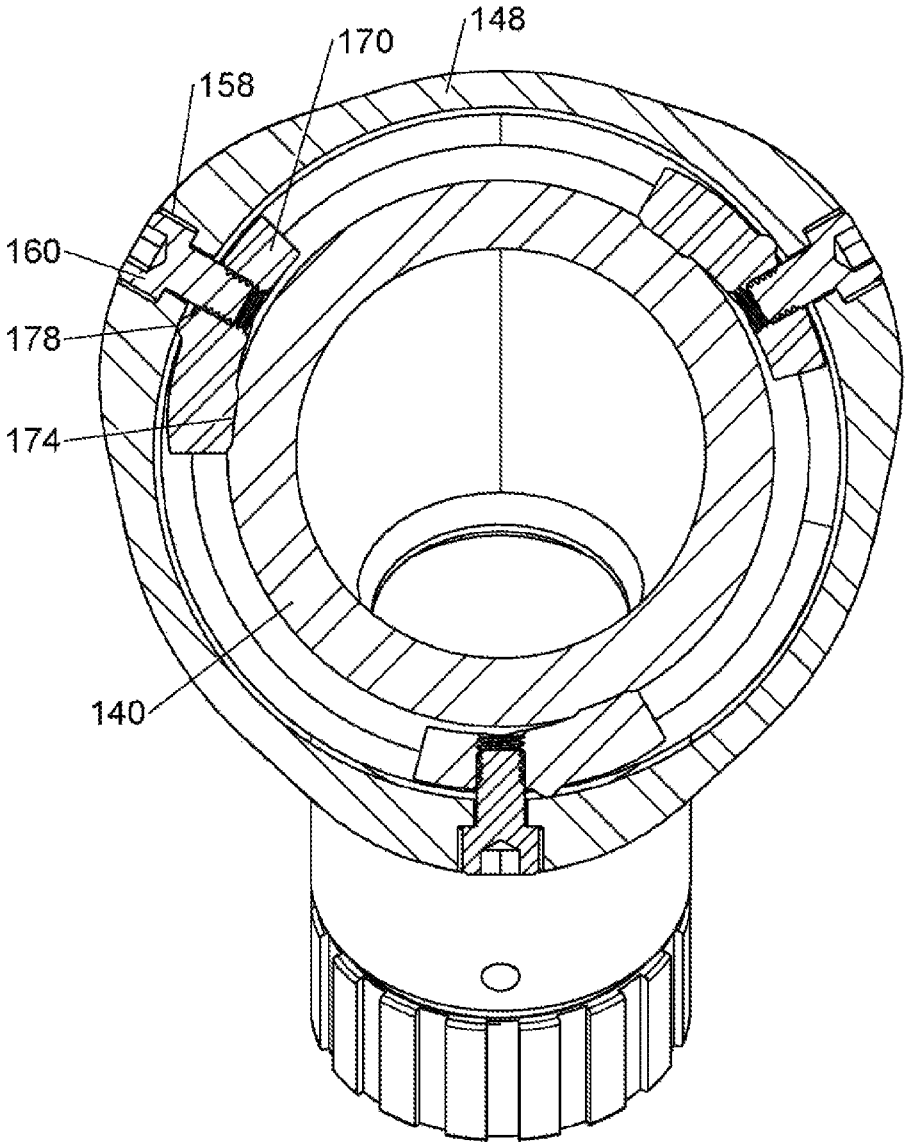
FIG. 16 is a cross sectional view taken through an angle of action of the swiveling joint of FIG. 11, showing the joint in a locked configuration.

When each bolt 160 is turned in a first direction, the body portion 170 adjacent the aperture 172 is urged towards the bolt receiving aperture 158. The raised portion 178 acts as a pivot against the inside of the skirt 148, urging the engaging portion 174 into engagement with the annular groove 136. Further tightening of the bolt 160 in this direction provides a wedging effect, with the engaging portions 174 clamping against the annular groove 136. The resulting friction is sufficient to lock the swiveling joint 110 into a desired position, with rotation prevented. This is shown in FIG. 16.

Figure 17:
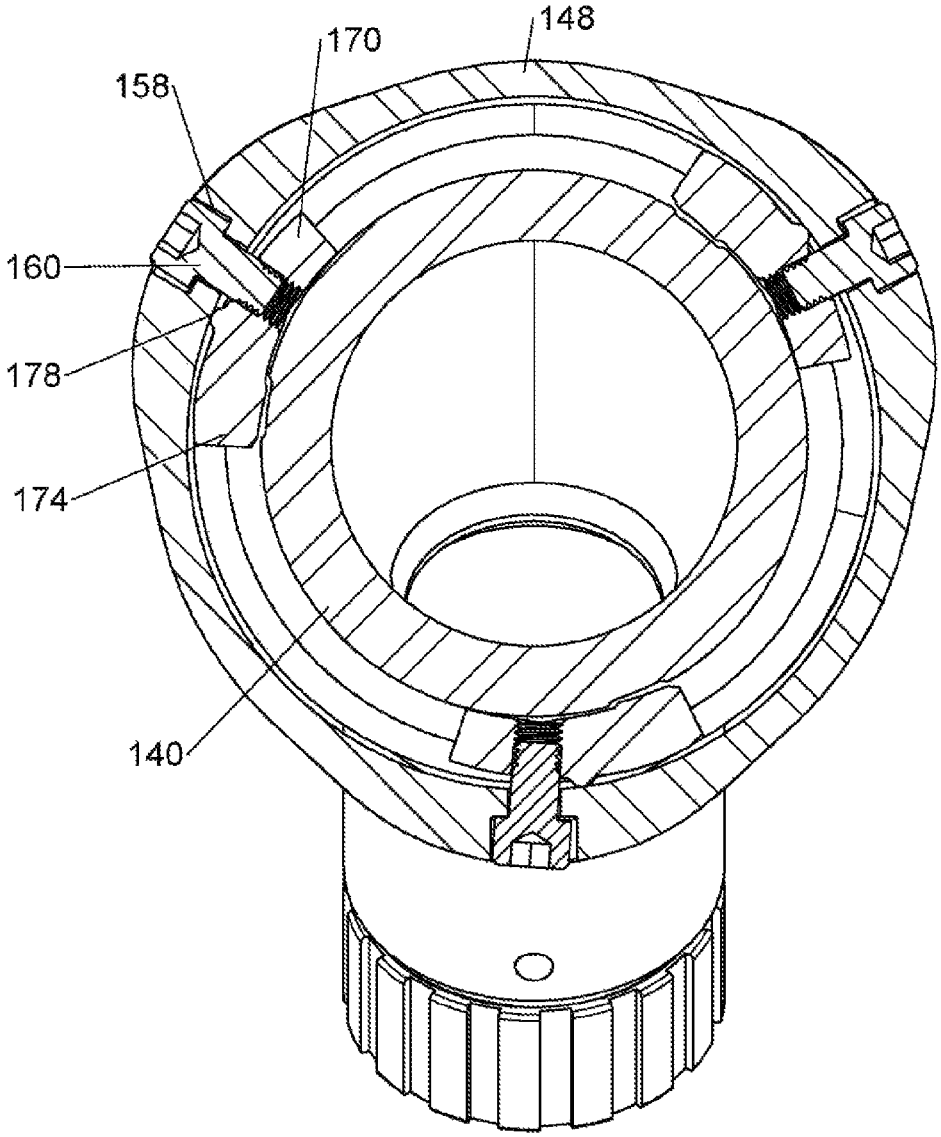
FIG. 17 is a cross sectional view taken through an angle of action of the swiveling joint of FIG. 11, showing the joint in a released configuration.

When the bolts 160 are turned in the other direction, the opposite effect takes place. The engaging portions 174 are released from active engagement with the annular groove 136, and are pulled outwardly as the body portion 170 adjacent the aperture 172 moves inwardly. Rotation of the second member 114 relative to the first member 112 about the offset axis is now permitted. The body portions 170 remain located within the annular groove 136, preventing complete disconnection of the second member 114 from the first member 112. This is shown in FIG. 17.

In one version (not shown), this embodiment includes an encircling spring around the bearing members 116, acting to urge the engaging portions towards the annular groove 136. This spring assists in tightening of the engaging portions 174.

Although not shown in the drawings, it is considered that a secondary locking means similar to that shown in the first embodiment could be readily added to the second embodiment.

A third embodiment of the present invention will be described with reference to FIGS. 18 to 25, in which there is shown a swiveling joint 210 having three main components: a first member 212, a second member 214 and a bearing member 216.

The first member 212 is associated with a first leg 218, which is oriented in a longitudinal direction. The first leg 218 terminates at a pole receiving aperture 220, which forms a cylindrical sleeve arranged to connect to a pole (such as the base of a light pole) by suitable means such as clamping or welding.

The second member 214 is associated with a second leg 224, which is oriented in a longitudinal direction. The second leg 224 terminates at a pole receiving aperture 226, which forms a cylindrical sleeve arranged to connect to a pole (such as the top portion of a light pole) by suitable means such as clamping or welding.

Figure 18:
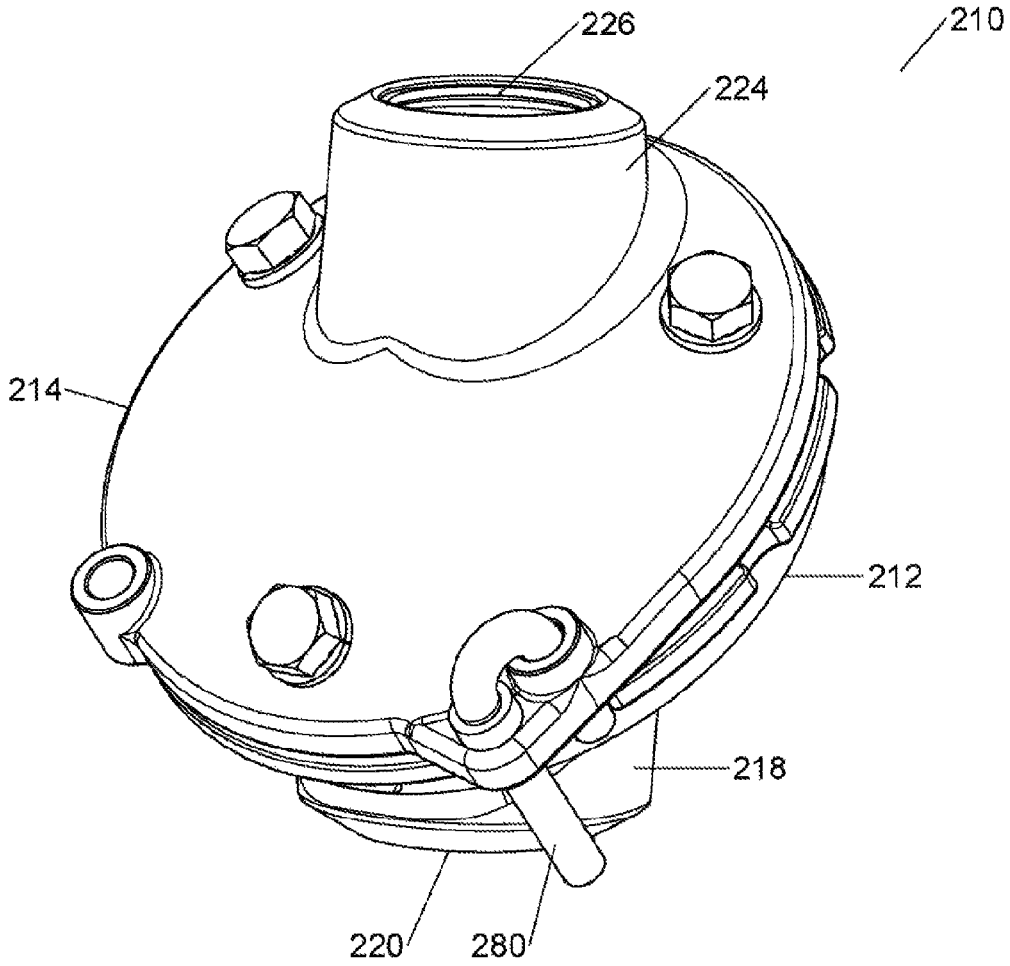
FIG. 18 is a perspective of a swiveling joint in accordance with a third embodiment of the present invention, shown in a first position.
Figure 19:
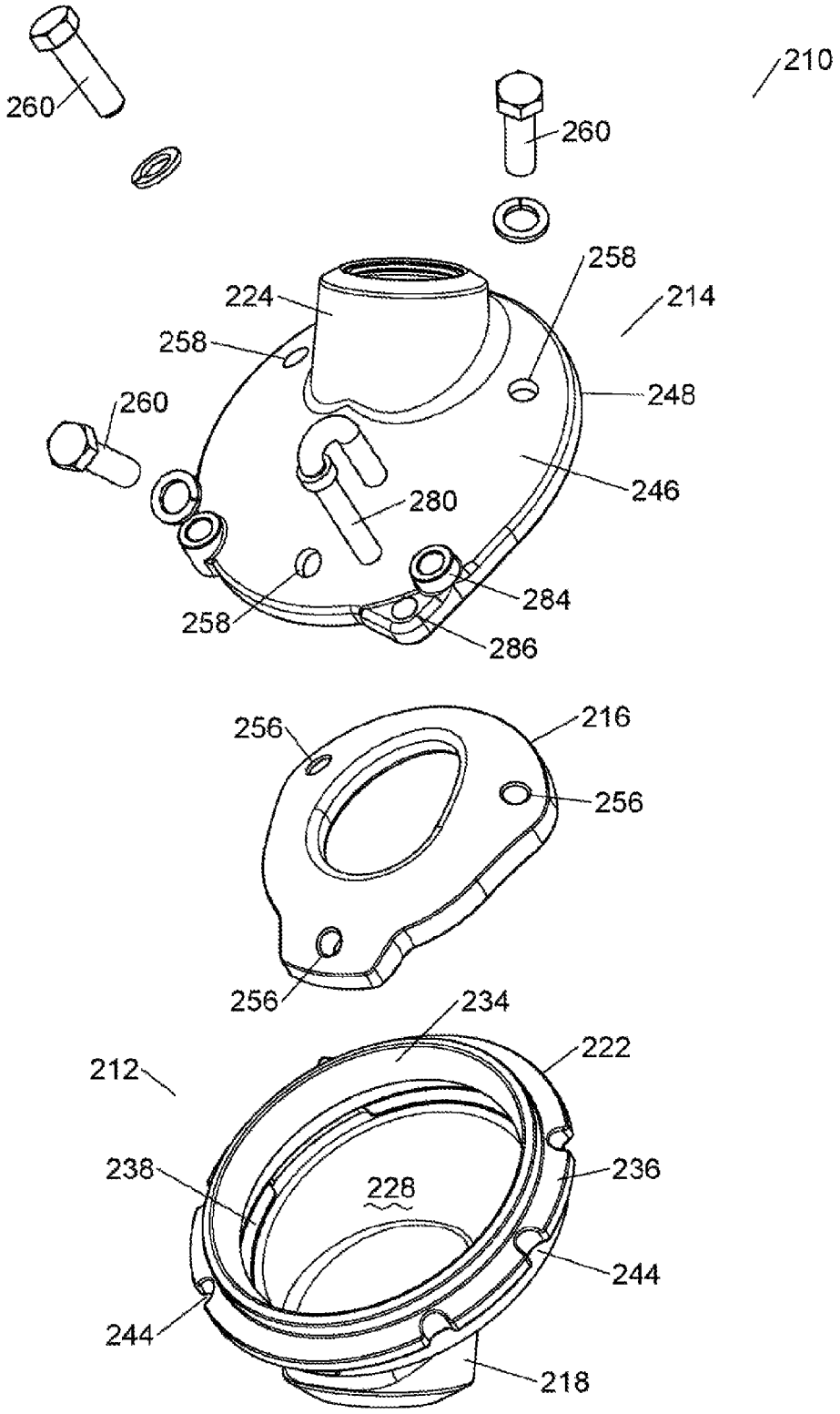
FIG. 19 is a front exploded view of the swiveling joint of FIG. 18.
Figure 20:
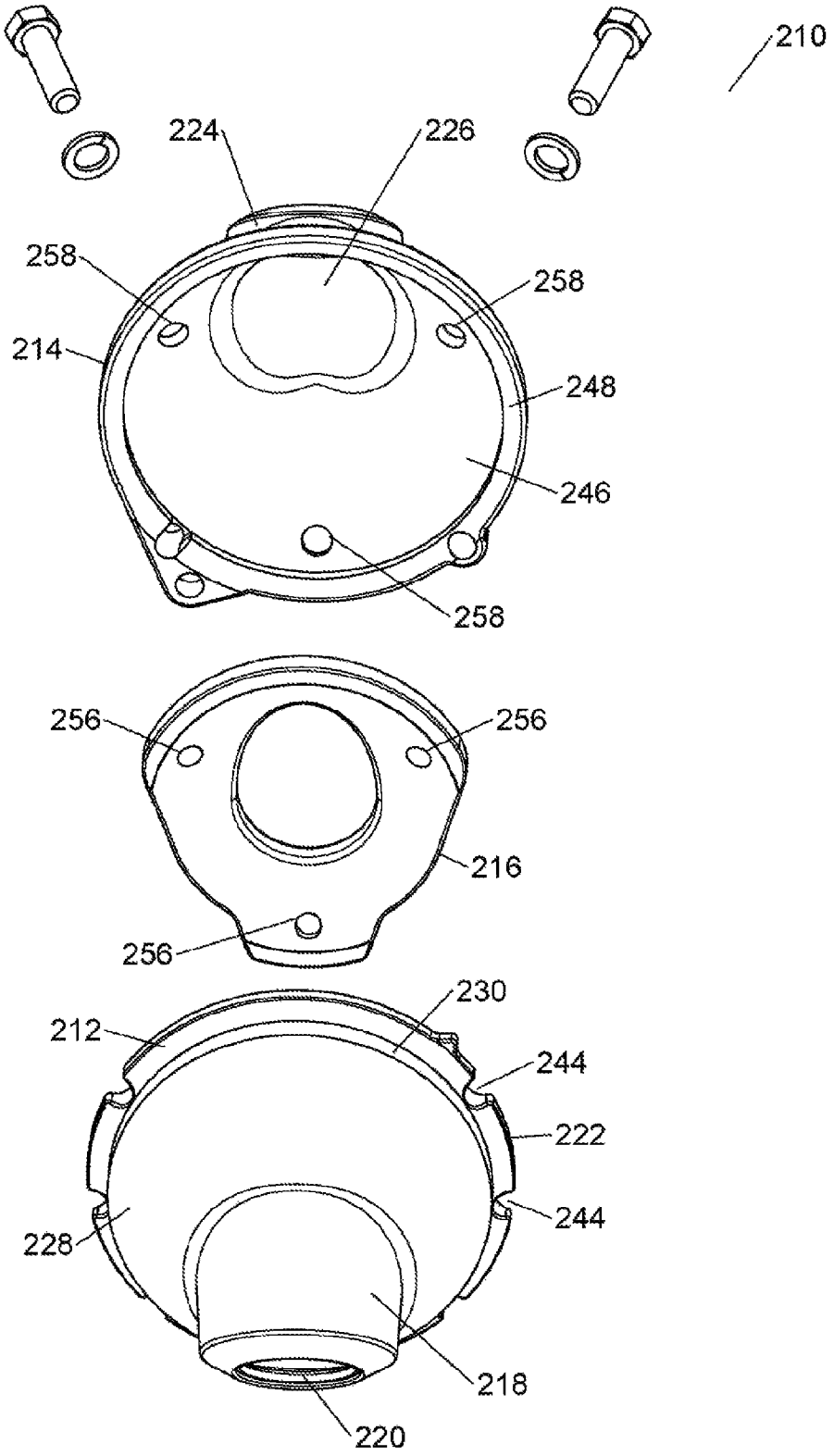
FIG. 20 is a rear exploded view of the swiveling joint of FIG. 18.
Figure 21:
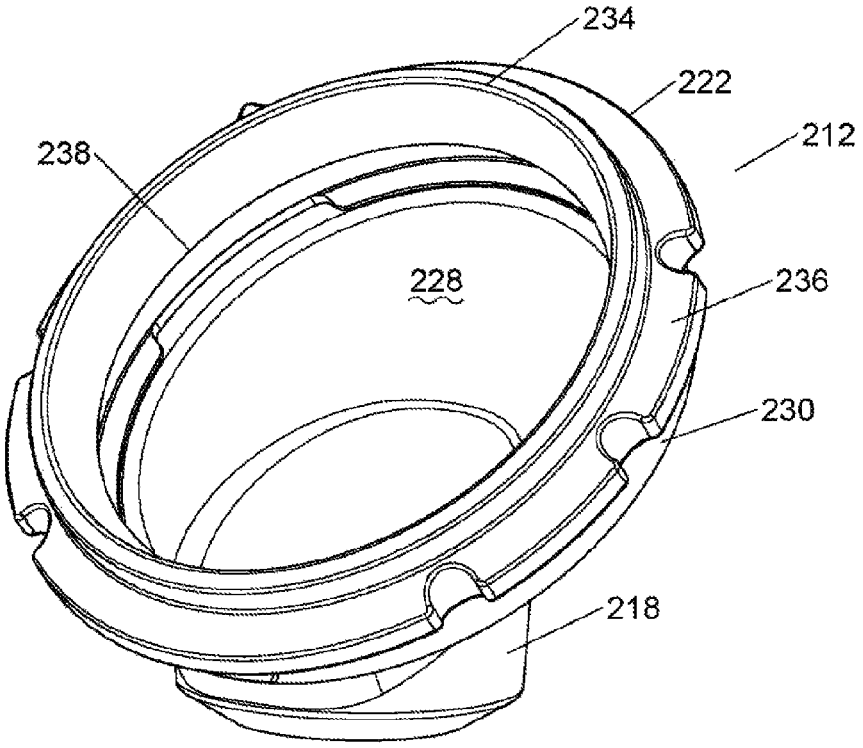
FIG. 21 is a perspective of a first member within the swiveling joint of FIG. 18.
Figure 22:
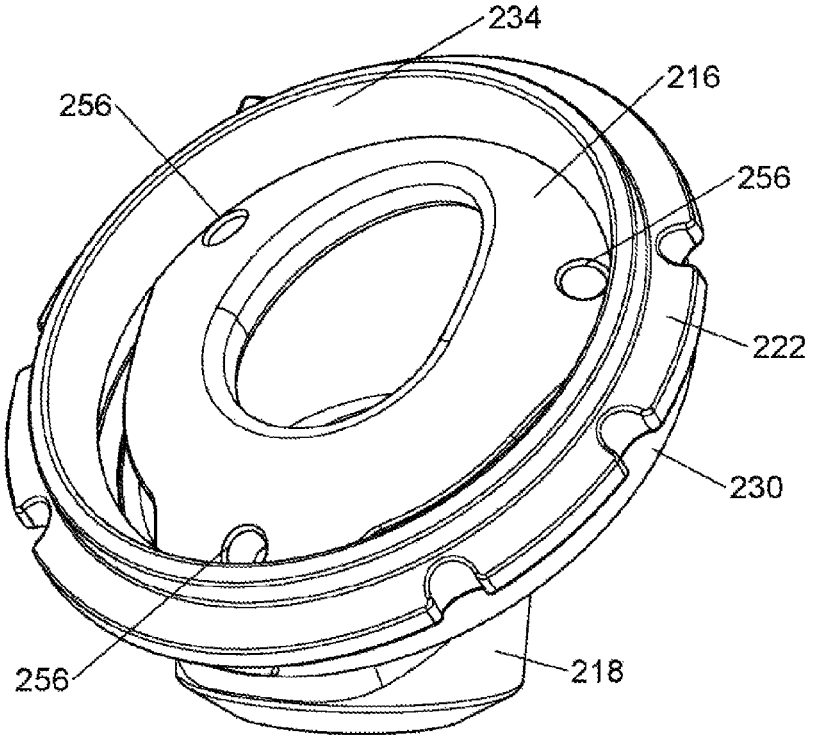
FIG. 22 is a perspective of the first member of FIG. 21 with a clamping member included.
Figure 23:
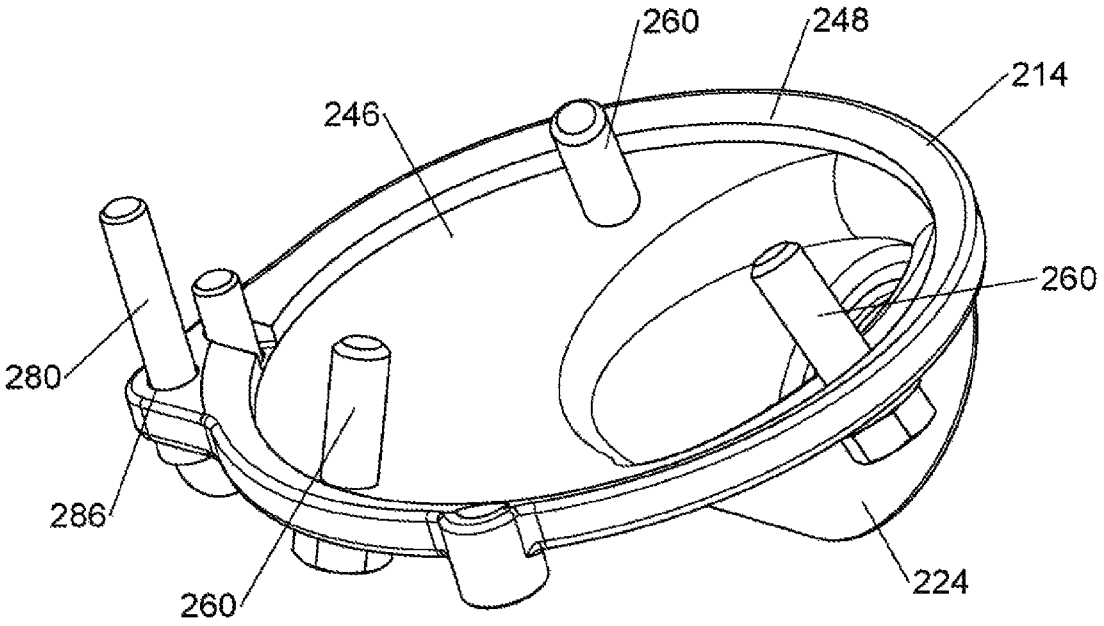
FIG. 23 is a lower perspective of a second member within the swiveling joint of FIG. 18.
Figure 24:
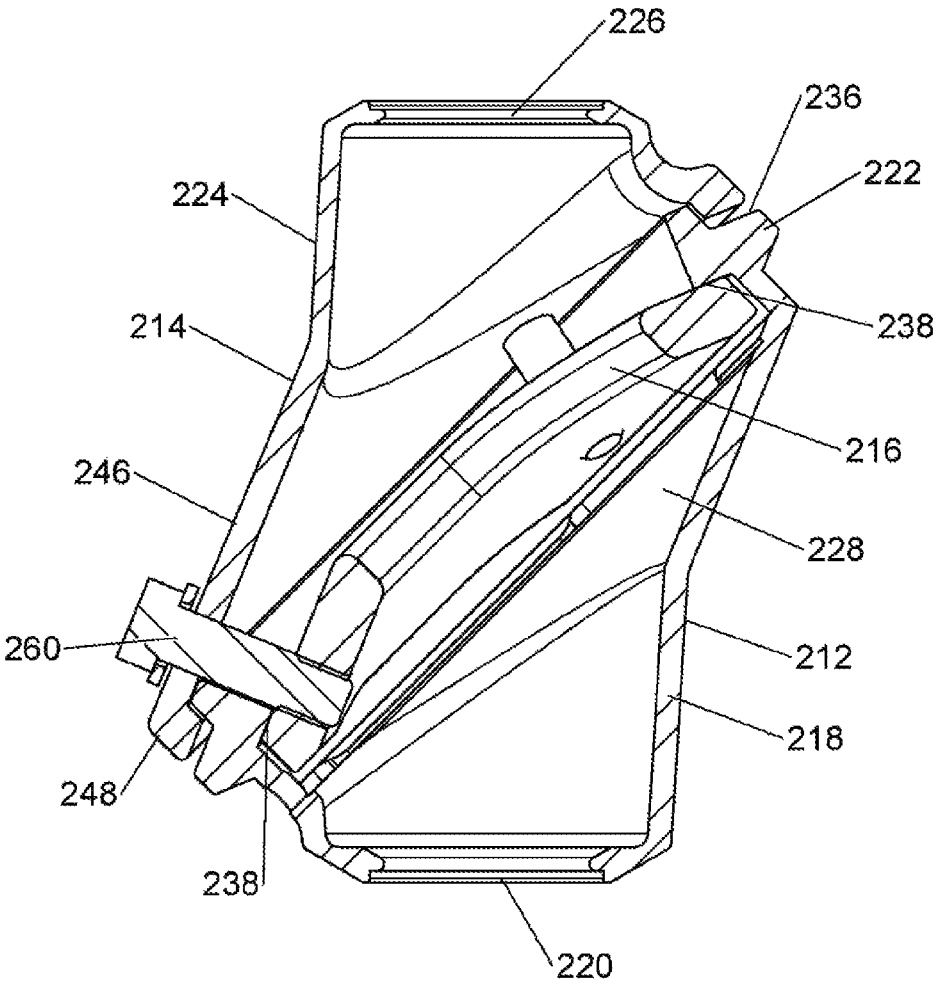
FIG. 24 is a side cross sectional view of the swiveling joint of FIG. 18.
Figure 25:
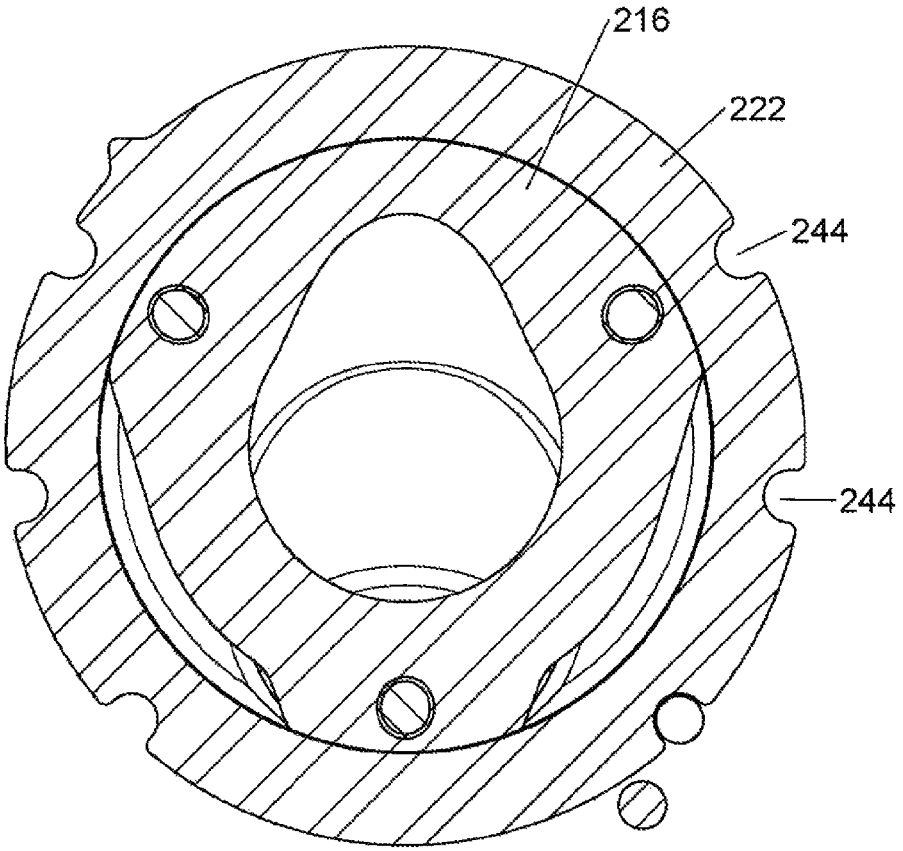
FIG. 25 is a cross sectional view taken through an angle of action of the swiveling joint of FIG. 18.

The arrangement is such that when the swiveling joint 210 is in a first position, as shown in FIG. 18, the first leg 218 and the second leg 224 can both be vertical, and aligned along a common longitudinal axis.

The first member 212 is generally hollow, and has a lower face 228, a generally cylindrical side wall 230, an upper shoulder 222, and an upwardly extending cylindrical projection 234. The first member 212 has a hollow body portion defined generally by the lower face 228 and the side wall 230.

The side wall 230 has a thickness of around 10° of its internal diameter. In the embodiment shown in the drawings, the side wall has an outer diameter of 175 mm and an internal diameter of 140 mm. The side wall 230 separates the lower face 228 and the upper shoulder 222. The upper shoulder 222 includes a number of 'cut out' portions or recesses 244.

The upper shoulder 222 extends internally of the side wall 230 and is opposed to the lower face 228. The upper shoulder 222 is generally annular, with an inner diameter equal to about 70% of the outer diameter of the side wall 230. In the embodiment shown, the upper shoulder has an internal diameter of about 125 mm.

The upper shoulder 222 has an outer face 236, on the outside of the first member 212, and an inner face 238, inside the first member 212 and facing the lower face 228. The inner face 238 is generally annular. In the preferred embodiment shown, the inner face 238 is frusto conical, with a cone angle of about 135°, and oriented such that the distance from the lower face 228 to the inner face 238 increases away from the side wall 230.

The inner face 238 is a bearing surface, oriented towards the hollow body portion.

The cylindrical projection 234 extends upwardly from the outer face 236 of the upper shoulder 222. The cylindrical projection 234 has an external diameter which is about 85% of the external diameter of the side wall 230. In the embodiment shown, the cylindrical projection 234 has an external diameter equal to about 147 mm.

The cylindrical projection may have a frusto conical internal shape, with an internal diameter increasing from the inner edge of the upper shoulder 222 to the upper edge of the cylindrical projection. The cone angle of this shape is about 45°.

The second member 214 has a generally frusto conical top surface 246 and a generally cylindrical skirt 248. The skirt 248 depends downwardly from the periphery of the top surface 246, and has an internal diameter equal to the external diameter of the cylindrical projection 234 of the first member 212. The skirt 248 of the second member 214 thus defines a circular recess within which the cylindrical projection 234 of the first member 212 can locate.

The second member 214 includes three bolt-receiving apertures 258 spaced at 120° intervals near the periphery of the top surface 246. The bolt receiving apertures 258 are located radially internally of the skirt 248 by a short distance. The bolt receiving apertures 258 are normal to the top surface 246; that is, are at an angle of about 22.5° relative to the longitudinal direction of the second leg 224, and are oriented towards a central axis of the second member 214 such that the distance from the skirt 248 to each of the bolt receiving apertures 258 increases away from the top surface 246.

The bearing member 216 is generally frusto conical, with a cone angle of 135°. It is also generally annular in shape, with an external diameter similar to the internal diameter of the side wall 230 of the first member 212, and an internal diameter about one third of its outer diameter. The bearing member 216 shown in the drawings has a height of about 12 mm. It is sized so as to locate in the hollow body portion of the first member 212, with an outer rim of the bearing member 216 locating under the shoulder 222 of the first member 212.

The bearing member 216 does not have a circular outer periphery. Instead, its outer periphery is shaped in such a fashion that the bearing member 216 can be inserted into the hollow body portion of the first member 212.

The bearing member 216 has three internally threaded bolt receiving apertures 256 spaced at 120° intervals near the periphery of the bearing member 216. The bolt receiving apertures 256 are perpendicular to an upper surface of the bearing member 216; that is, they are inclined at 22.5° relative to a central axis of the bearing member 216. The radial position of the bolt receiving apertures 256 is matched to that of the bolt receiving apertures 258 of the second member 214 as described below.

The swiveling joint 210 is assembled by maneuvering the bearing member 216 into the hollow body portion of the first member 212, such that an outer rim of the conical upper surface of the bearing member 216 abuts the inner face 238 of the shoulder 222 of the first member 212. The second member 214 can then be located over the first member 212, with the cylindrical projection 234 of the first member 212 locating within the circular recess defined by the skirt 248 of the second member 214. The upper edge of the cylindrical projection 234 of the first member 212 is in contact with the circular recess of the second member 214 along a connection annulus.

During this stage of assembly, the second member 214 can rotate freely about the cylindrical projection 234. It can therefore be rotated until the bolt receiving apertures 258 of the second member 214 align with the bolt receiving apertures 256 of the bearing member 216. It will be appreciated that these bolt receiving apertures are all aligned at 22.5° to a central axis of the swiveling joint 210, and that their respective radial positions allow the bolt receiving apertures 256, 258 to be axially aligned when the second member 214 is rotated to the correct position.

Adjustable connection means in the form of bolts 260 can be inserted through the bolt receiving apertures 258, and received in the threads of the bolt receiving apertures 256. This arrangement is shown in cross-section in FIG. 24.

Tightening of the bolts 260 causes the outer rim of the bearing member 216, which acts as an annular outer bearing surface, to bear upwardly against the inner face 238 of the shoulder 222 of the first member 212.

The swiveling joint 210 is thus moveable between two configurations: a first configuration in which the bolts 260 are tight, and a second configuration in which the bolts 260 are loose.

In the first configuration the bearing surface of the bearing member 216 is held tightly against the bearing surface of the first member 212. The resulting friction prevents relative rotation of the bearing member 216 and the first member 212, and thus prevents relative rotation of the first member 212 and the second member 214.

In the second configuration the action of the bearing member 216 against the shoulder 222 prevents the separation of the first member 212 from the second member 214. The absence of pressure—and significant friction—between the bearing member 216 and the shoulder 222 allows free rotation of the bearing member 216 and thus the second member 214 relative to the first member 212. The swiveling joint can therefore act in a similar fashion to the Swivelpole joint of PCT publication number WO0125687.

It will be appreciated that the interplay between the cylindrical projection 234 of the first member 212 and the circular recess of the second member 214 not only provides a 'track' about which rotation can occur, but also acts as a water impeding ring to prevent the ingress of water into the hollow body portion of the first member 212. The bolts 260 are all located radially internally of this water impeding ring, and therefore are kept relatively free from water and other contaminants.

The angling of the bolts 260 at 22.5° to a central axis of the swiveling joints 210, and the matching use of angled and frusto conical surfaces, assists in locating the bolts 260 as far away from the central axis as possible, while keeping the bolts 260 within the water impeding ring. This assists both in force distribution and in ease of operation of the bolts 260. It will noted, however, that this angling is not essential to the operation of the invention, and although an angle of 22.5° is considered the easiest for manufacturing purposes it is by no means the only useful angle at which the bolts 260 can be inclined. Similarly, although the bolt 260 acts through surfaces generally perpendicular to it, this is not essential to the operation of the invention.

The swiveling joint 210 includes a secondary locking means, to enable the swiveling joint 210 to be secured in a desired rotational position during tightening or loosening of the bolts 260. This secondary locking means is formed by the use of a secondary locking pin 280 within aligned secondary apertures 284 of the second member 214 and recesses 244 of the first member 212.

The secondary apertures 284 of the second member 214 are located near a periphery of the second member 214; that is, within the skirt 248 and therefore outside of the water impeding ring.

The recesses 244 of the first member 212 are formed as axially aligned recesses extending inwardly from the outer periphery of the side wall 230 of the first member 212.

In the embodiment shown the secondary locking pin 280 is U-shaped, with one arm of the pin 280 secured within a pin holding aperture 286 adjacent a secondary aperture 284 of the second member 214.

When the second member 214 is in a desired rotational position relative to the first member 212, at least one secondary aperture 284 of the second member 214 will be aligned with a recess 244 of the first member 212. The secondary locking pin 280 can be located within the aligned secondary aperture 284 and recess 244 to maintain the swiveling joint 210 in this desired position.

It will be appreciated that the secondary apertures 284 and recesses 244 are designed to be free-draining, so that any water or other contaminants can readily drain away.

Modifications and variations as would be apparent to a skilled addressee are deemed to be within the scope of the present invention.

The invention claimed is:

1. A swivelling joint including a first member, a second member, and at least one bearing member;

the first member being associated with a first leg, the first leg having a longitudinal direction, the first member having an annular base which is oriented at an acute angle relative to the longitudinal direction of the first leg, the base having an outer periphery;

the second member being associated with a second leg, the second leg having a longitudinal direction, the second member including an outer wall arranged to locate around the annular base of the first member to define an exterior surface of the swivelling joint;

the first member having a bearing surface located internally of the exterior surface of the swivelling joint;

the bearing member being connected to the second member by an adjustable connection means;

the bearing member locating within the outer wall of the second member, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

2. A swivelling joint as claimed in claim 1, wherein the outer wall of the second member and the periphery of the annular base of the first member combine to define a circular track about which the second member can rotate relative to the first member when in the second configuration.

3. A swivelling joint as claimed in claim 1, wherein the bearing surface of the first member is annular.

4. A swivelling joint as claimed in claim 3, wherein the bearing surface of the first member is formed by an annular groove.

5. A swivelling joint as claimed in claim 4, wherein the annular groove is formed from three surfaces: a cylindrical centre surface and two frusto conical outer surfaces.

6. A swivelling joint as claimed in claim 1, wherein the adjustable connection means includes a threaded bolt, such that threaded movement of the bolt causes movement between first and second configurations.

7. A swivelling joint as claimed in claim 6, wherein the bolt is generally tangential to the annular base.

8. A swivelling joint as claimed in claim 6, wherein the bolt is generally radial relative to the annular base.

9. A swivelling joint as claimed in claim 6, wherein the bolt is axial to the annular base, or offset relative to an axial direction.

10. A swivelling joint as claimed in claim 6, wherein the bearing member includes an internally threaded body portion arranged to engage with threads on the bolt.

11. A swivelling joint as claimed in claim 10, wherein the body portion is integral with an engaging portion of the bearing member, the engaging portion including the bearing surface.

12. A swivelling joint including a first member, a second member, and at least one bearing member;

the first member being associated with a first leg, the first leg having a longitudinal direction, the first member having an annular base which is oriented at an acute angle relative to the longitudinal direction of the first leg, the base having an outer periphery;

the second member being associated with a second leg, the second leg having a longitudinal direction, the second member including an outer wall arranged to locate around the annular base of the first member to define an exterior surface of the swivelling joint;

the second member having a bearing surface located internally of the exterior surface of the swivelling joint;

the bearing member being connected to the first member by an adjustable connection means;

the bearing member locating within the outer wall of the second member, with the bearing surface of the bearing member being opposed to the bearing surface of the second member;

the adjustable connection means permitting relative movement of the bearing member and the first member between:

a first configuration, wherein the hearing surface of the bearing member and the bearing surface of the second member are in frictional engagement restricting rotational movement of the first member relative to the second member, and a second configuration, wherein rotation of the second member relative to the first member is permitted.

13. A swivelling joint as claimed in claim 12, wherein the bearing surface of the first member is annular.

14. A swivelling joint as claimed in claim 13, wherein the bearing surface of the first member is formed by an annular groove.

15. A swivelling joint including first member, a second member, and at least one bearing member;

the first member being associated with a first leg, the first leg having a longitudinal direction, the first member having a base, the base having an outer periphery, the outer periphery being located in a plane, the plane being perpendicular to an operating axis, the operating axis being angled with respect to the longitudinal axis of the first leg at an offset angle;

the second member being associated with a second leg, the second leg having a longitudinal direction, the second member including an outer wall arranged to locate around the annular base of the first member to define an exterior surface of the swivelling joint;

the first member having a bearing surface located internally of the exterior surface of the swivelling joint;

the bearing member being connected to the second member by an adjustable connection means;

the bearing member locating within the outer wall of the second member, with the bearing surface of the bearing member being opposed to the bearing surface of the first member;

the adjustable connection means permitting relative movement of the bearing member and the first member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

16. A swivelling joint including a first member, a second member, and a bearing member;

the first member being associated with a first leg, the first leg having a longitudinal direction, the first member having a hollow body portion, the first member having a bearing surface which is oriented at an acute angle relative to the longitudinal direction of the first leg, the bearing surface facing towards the hollow body portion;

the second member being associated with a second leg, the second leg having a longitudinal direction;

the bearing member being connected to the second member by an adjustable connection means, the bearing member having a bearing surface which is oriented at an acute angle relative to the longitudinal direction of the first leg;

the bearing member locating within the hollow body portion of the first member, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to the first member is permitted.

17. A swivelling joint including a first member, a second member, and a bearing member; the first member being associated with a longitudinally extending first leg, the first leg having a longitudinal direction, the first member having a hollow body portion, the first member having a bearing surface which is oriented at an acute angle relative to the longitudinal direction of the first leg, the bearing surface facing towards the first leg;

the second member being associated with a longitudinally extending second leg, the second leg having a longitudinal direction;

the first member and the second member being arranged to meet along a connection annulus, the bearing member being connected to the second member by an adjustable connection means, the bearing member having a bearing surface which is oriented at an acute angle relative to the longitudinal direction of the first leg;

the bearing member locating inside the connection annulus, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting relative movement of the first member and the second member, and a second configuration, wherein rotation of the second member relative to the first member is permitted.

18. A swivelling joint including a first member, a second member, and a bearing member;

the first member being associated with a first leg, the first leg having a longitudinal direction, the first member having a hollow body portion, the first member having a bearing surface which is oriented at an acute angle relative to the longitudinal direction of the first leg, the bearing surface facing towards the hollow body portion;

the second member being associated with a second leg, the second leg having a longitudinal direction;

the bearing member being connected to the second member by an adjustable connection means, the bearing member having a bearing surface which is oriented at an acute angle relative to the longitudinal direction of the first leg;

the bearing member locating within the hollow body portion of the first member, with the bearing surface of the bearing member being opposed to the bearing surface of the first member;

the adjustable connection means permitting relative movement of the bearing member and the second member between:

a first configuration, wherein the hearing surface of the bearing member and the bearing surface of the first member are in frictional engagement restricting rotational movement of the first member relative to the second member, and a second configuration, wherein rotation of the second member relative to the first member is permitted.

19. A swivelling joint including a first member, a second member, and a bearing member;

the first member being associated with a longitudinally extending first leg, the first leg having a longitudinal direction, the first member having a hollow body portion, the first member having a bearing surface which is oriented at an acute angle relative to the longitudinal direction of the first leg, the bearing surface facing towards the first leg;

the second member being associated with a longitudinally extending second leg, the second leg having a longitudinal direction;

the first member and the second member being arranged to meet along a connection annulus, the bearing member being connected to the second member by an adjustable connection means, the bearing member having a bearing surface which is oriented at an acute angle relative to the longitudinal direction of the first leg;

the bearing member locating inside the connection annulus, with the bearing surface of the bearing member being opposed to the bearing surface of the first member;

the adjustable connection means permitting relative movement of the bearing member and the second member between:

a first configuration, wherein the bearing surface of the bearing member and the bearing surface of the first member are in frictional engagement restricting rotational movement of the first member relative to the second member, and a second configuration, wherein rotation of the second member relative to e first member is permitted.

* * * * *